US008876672B2

(12) United States Patent
Schiano

(10) Patent No.: US 8,876,672 B2
(45) Date of Patent: Nov. 4, 2014

(54) METHOD AND APPARATUS FOR EXERCISE DEVICE

(76) Inventor: Mark Schiano, Pearl River, NY (US)

( * ) Notice: Subject to any disclaimer, the term of this patent is extended or adjusted under 35 U.S.C. 154(b) by 507 days.

(21) Appl. No.: 13/168,369

(22) Filed: Jun. 24, 2011

(65) Prior Publication Data

US 2012/0329613 A1 Dec. 27, 2012

(51) Int. Cl.

| | |
|---|---|
| ***A63B 21/00*** | (2006.01) |
| ***B23P 11/00*** | (2006.01) |
| ***A63B 21/078*** | (2006.01) |

(52) U.S. Cl.

CPC ..... *A63B 21/078* (2013.01); *A63B 2021/0786* (2013.01)

USPC ..... 482/94; 482/104

(58) Field of Classification Search

CPC ..... A63B 21/062; A63B 2021/0623; A63B 21/078; A63B 21/1469; A63B 2225/09; A63B 21/0552; A63B 21/1434; A63B 2022/0079

USPC ..... 482/91–93, 98–99, 102–104, 142–144, 482/148, 908; 59/1–35.1, 78–95; 29/428

See application file for complete search history.

(56) References Cited

U.S. PATENT DOCUMENTS

| | | | | |
|---|---|---|---|---|
| 2,895,290 | A * | 7/1959 | Devonshire et al. | 59/90 |
| 4,216,959 | A | 8/1980 | Niles | 272/123 |
| 5,989,166 | A * | 11/1999 | Capizzo et al. | 482/104 |
| 6,928,835 | B1 * | 8/2005 | Cousin et al. | 63/39 |
| 7,722,514 | B2 * | 5/2010 | Paine, Jr. | 482/143 |
| 8,444,537 | B1 * | 5/2013 | Santoro | 482/104 |
| 2002/0016239 | A1 * | 2/2002 | Slawinski et al. | 482/104 |
| 2004/0092369 | A1 * | 5/2004 | Slawinski et al. | 482/104 |
| 2004/0176224 | A1 * | 9/2004 | Slawinski | 482/93 |
| 2004/0192519 | A1 * | 9/2004 | Slawinski | 482/99 |
| 2005/0233871 | A1 * | 10/2005 | Anders et al. | 482/93 |
| 2006/0019804 | A1 * | 1/2006 | Young | 482/93 |
| 2007/0155596 | A1 * | 7/2007 | Rogers et al. | 482/97 |
| 2009/0105055 | A1 * | 4/2009 | Piane, Jr. | 482/142 |
| 2009/0223200 | A1 * | 9/2009 | Kinert et al. | 59/84 |
| 2009/0312162 | A1 * | 12/2009 | Maiaro et al. | 482/104 |
| 2011/0230316 | A1 | 9/2011 | Johnson, III | 482/104 |

* cited by examiner

*Primary Examiner* — Loan H Thanh
*Assistant Examiner* — Andrew S Lo
(74) *Attorney, Agent, or Firm* — Walter J. Tencza, Jr.

(57) ABSTRACT

An apparatus including a rigid frame structure, a first device for holding a first end of a first weightlifting bar, and a second device for holding a second end of a first weightlifting bar, opposite the first end of the weightlifting bar, is provided. The first device may include a first flexible device and a first retainer device. The second device may include a second flexible device and a second retainer device. The first and second flexible devices can be removably attached to the rigid frame structure. The apparatus provides a safe structure for working out with free weights.

20 Claims, 13 Drawing Sheets

METHOD AND APPARATUS FOR EXERCISE DEVICE

FIELD OF THE INVENTION

This invention relates to improved methods and apparatus concerning exercise devices.

BACKGROUND OF THE INVENTION

There are various devices known in the prior art for exercise devices.

SUMMARY OF THE INVENTION

The present invention, in at least one embodiment includes an apparatus comprising a rigid frame structure, a first device for holding a first end of a first weightlifting bar, and a second device for holding a second end of a first weightlifting bar, opposite the first end of the weightlifting bar.

The first device may include a first flexible device and a first retainer device. The first flexible device may have a first end and an opposite second end. The first retainer device may be attached to the first flexible device at a location which is at the second end of the first flexible device or which is between the first end of the first flexible device and the second end of the first flexible device. The first flexible device may be removably attached to the rigid frame structure at the first end of the first flexible device or at any one of a plurality of locations between the first end of the first flexible device and the second end of the first flexible device.

The second device may include a second flexible device and a second retainer device. The second flexible device may have a first end and an opposite second end. The second retainer device may be attached to the second flexible device at a location which is at the second end of the second flexible device or which is between the first end of the second flexible device and the second end of the second flexible device. The second flexible device can be removably attached to the rigid frame structure at the first end of the second flexible device or at any one of a plurality of locations between the first end of the second flexible device and the second end of the second flexible device.

The first weightlifting bar may be a weightlifting dumbbell or a weightlifting barbell. The first flexible device may include a chain having a plurality of chain links. The second flexible device may include a chain having a plurality of chain links. The first flexible device may include a plurality of tags indicating a plurality of sequential settings at which the first flexible device can be removably attached to the rigid frame structure at the first end of the first flexible device or at any one of the plurality of locations between the first end of the first flexible device and the second end of the first flexible device. The second flexible device may include a plurality of tags indicating a plurality of sequential settings at which the second flexible device can be removably attached to the rigid frame structure at the first end of the second flexible device or at any one of the plurality of locations between the first end of the second flexible device and the second end of the second flexible device.

The apparatus may further include a first elastic cord device having a first end removably attached to the rigid frame structure and a second end, opposite the first end of the first elastic cord device, removably attached to the first flexible device at a location between the first end of the first flexible device and the second end of the first flexible device. The apparatus may further include a second elastic cord device having a first end removably attached to the rigid frame structure and a second end, opposite the first end of the first elastic cord device, removably attached to the second flexible device at a location between the first end of the second flexible device and the second end of the second flexible device.

The rigid frame structure may have an overall height which is adjustable. The rigid frame structure may have a top structure having a length which is adjustable. The top structure may include a first inner rigid beam which telescopes inside of a first outer rigid beam, and a second inner rigid beam which telescopes inside of a second outer rigid beam. The telescoping of the first inner rigid beam within the first outer rigid beam together with the telescoping of the second inner rigid beam within the second outer rigid beam may adjust the length of the top structure.

The apparatus may further include a first means for preventing the first inner rigid beam from falling out of the first outer rigid beam, and a second means for preventing the second inner rigid beam from falling out of the second outer rigid beam.

In at least one embodiment the apparatus may include a third device for holding a first end of a second weightlifting bar, and a fourth device for holding a second end of the second weightlifting bar.

The third device may include a third flexible device and a third retainer device. The third flexible device has a first end and an opposite second end. The third retainer device may be attached to the third flexible device at a location which is at the second end of the third flexible device or which is between the first end of the third flexible device and the second end of the third flexible device. The third flexible device can be removably attached to the rigid frame structure at the first end of the third flexible device or at any one of a plurality of locations between the first end of the third flexible device and the second end of the third flexible device;

The fourth device may include a fourth flexible device and a fourth retainer device. The fourth flexible device has a first end and an opposite second end. The fourth retainer device may be attached to the fourth flexible device at a location which is at the second end of the fourth flexible device or which is between the first end of the fourth flexible device and the second end of the fourth flexible device. The fourth flexible device can be removably attached to the rigid frame structure at the first end of the fourth flexible device or at any one of a plurality of locations between the first end of the fourth flexible device and the second end of the fourth flexible device. The third flexible device and the fourth flexible device may each include a chain having a plurality of chain links.

In at least one embodiment of the present invention a method is provided which includes attaching a first retainer device to a first flexible device at a location which is at a second end of the first flexible device or which is between a first end of the first flexible device and the second end of the first flexible device. The method may also include removably attaching the first flexible device to a rigid frame structure at the first end of the first flexible device or at any one of a plurality of locations between the first end of the first flexible device and the second end of the first flexible device. The method may further include inserting a first end of a first weightlifting bar into the first retainer device;

The method may further include attaching a second retainer device to a second flexible device at a location which is at a second end of the second flexible device or which is between a first end of the second flexible device and the second end of the second flexible device; and removably attaching the second flexible device to the rigid frame structure at the first end of the second flexible device or at any one of a plurality of locations between the first end of the second flexible device and the second end of the second flexible device. The method may further include inserting a second end of the first weightlifting bar, opposite the first end of the first weightlifting bar, into the second retainer device.

DETAILED DESCRIPTION OF THE DRAWINGS

Figure 1A:
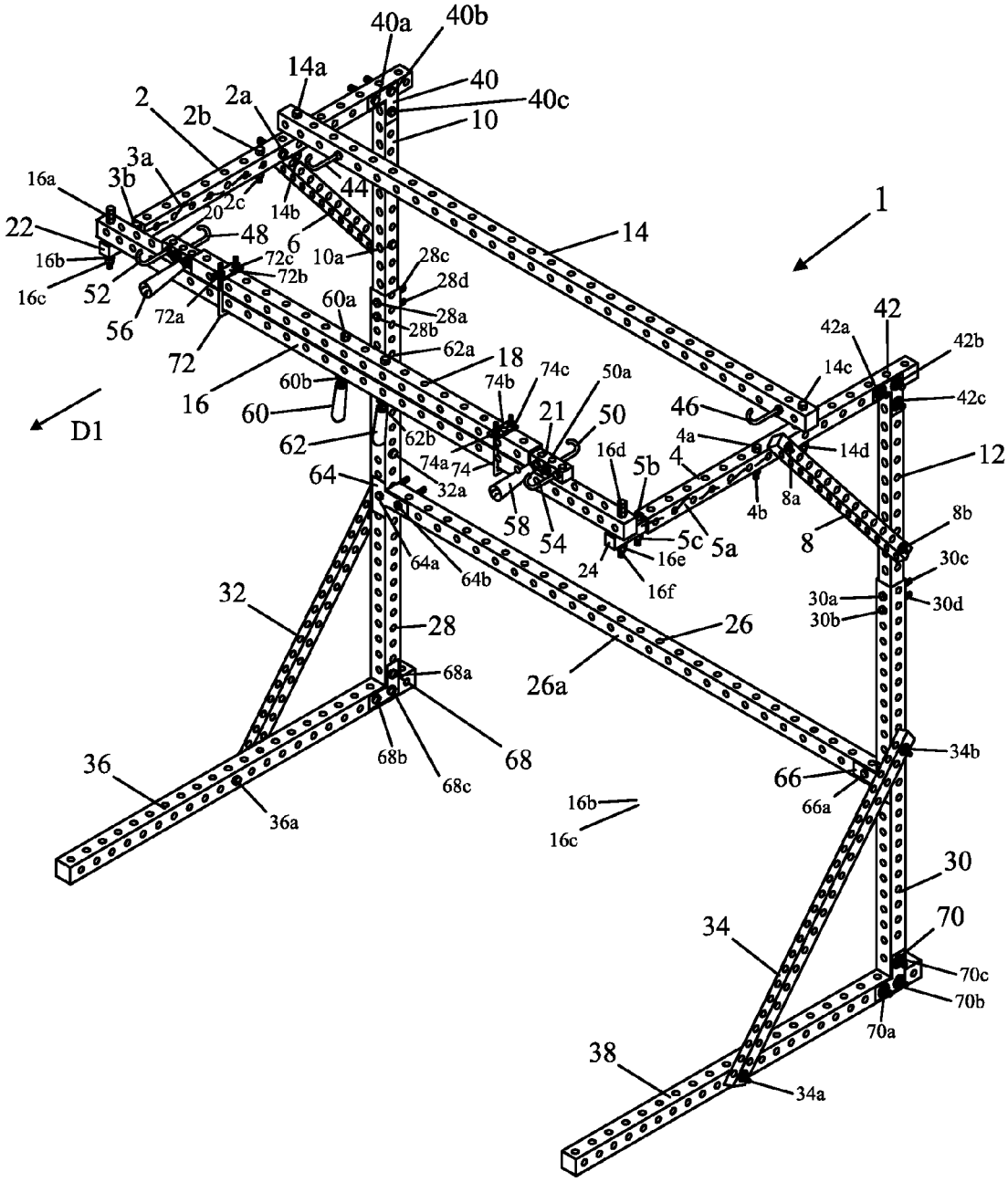
FIG. 1A shows a front, right side, top perspective view of an apparatus in accordance with an embodiment of the present invention, with the apparatus shown in a first state.
Figure 1B:
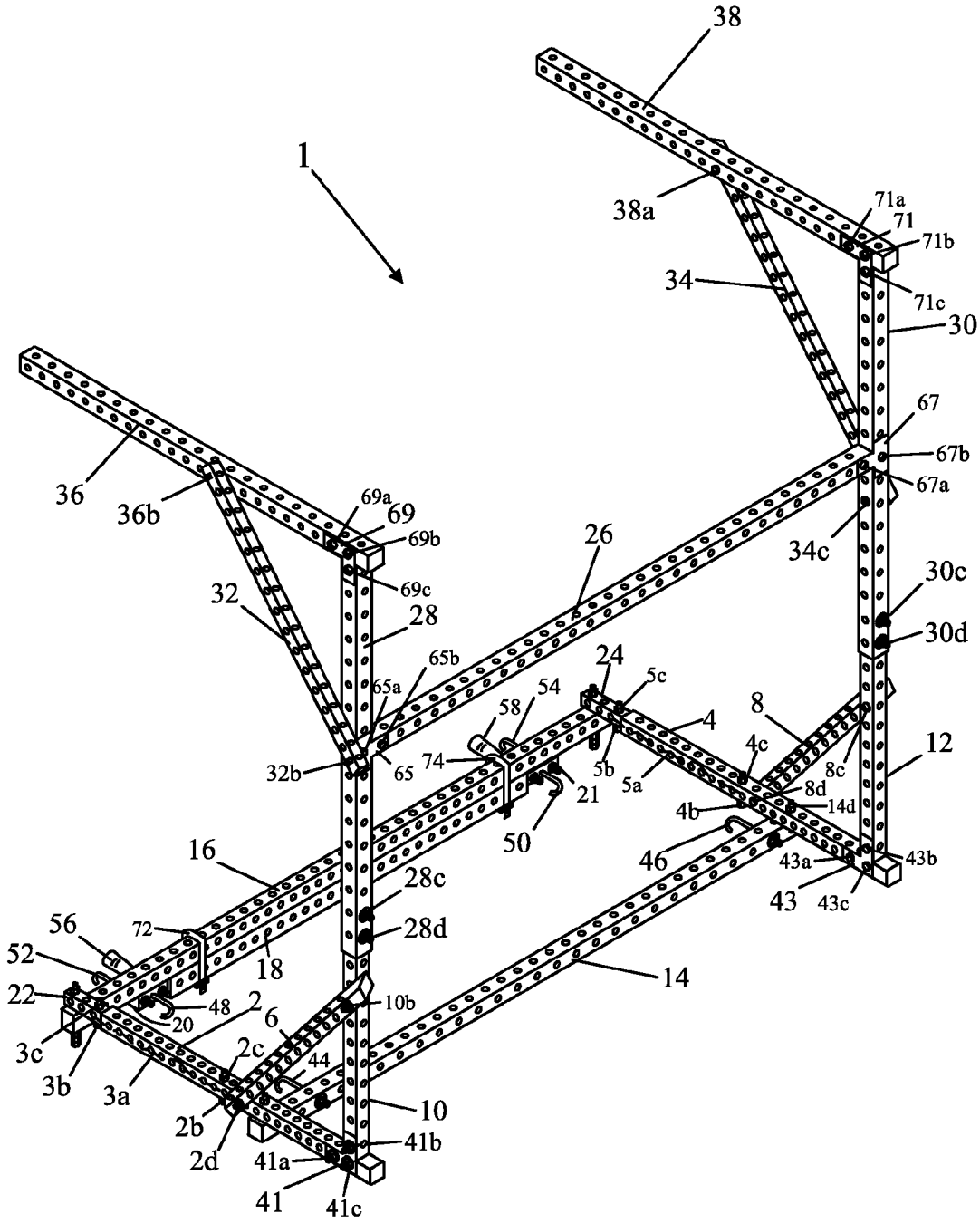
FIG. 1B shows a bottom, left side, back perspective view of the apparatus of FIG. 1A with the apparatus shown in the first state.

FIG. 1A shows a front, right side, top perspective view of an apparatus 1 in accordance with an embodiment of the present invention. FIG. 1B shows a bottom, left side, back perspective view of the apparatus 1, with the apparatus 1 shown in the first state.

Referring to FIGS. 1A-B, the apparatus 1 includes members or beams 2, 4, 6, 8, 10, 12, 14, 16, 18, 20, 21, 22, 24, 26, 28, 30, 32, 34, 36, and 38. Each of the members or beams 2, 4, 6, 8, 10, 12, 14, 16, 18, 20, 21, 22, 24, 26, 28, 30, 32, 34, 36, and 38 may be made of steel or some other type of rigid, strong metal. Each of the members or beams 2, 4, 6, 8, 10, 12, 14, 16, 18, 20, 21, 22, 24, 26, 28, 30, 32, 34, 36, and 38 may be hollow and may have a plurality of holes, as shown for inserting a pin part of a bolt into. The plurality of holes may be uniformly space along each of the members or beams 2, 4, 6, 8, 10, 12, 14, 16, 18, 20, 21, 22, 24, 26, 28, 30, 32, 34, 36, and 38. The members or beams 2, 4, 6, 8, 10, 12, 14, 16, 18, 20, 21, 22, 24, 26, 28, 30, 32, 34, 36, and 38 may, in combination be referred to as a rigid frame structure. A portion of the members or beams 2, 4, 6, 8, 10, 12, 14, 16, 18, 20, 21, 22, 24, 26, 28, 30, 32, 34, 36, and 38 may also be referred to as a rigid frame structure.

The apparatus 1 may also include L-shaped brackets 40, 41, 42, 43, 68, and 70 and T-shaped brackets 64, 65, 66, and 67. The L-shaped bracket 40 may be used to fix the horizontal member or beam 2 to the vertical member or beam 10, along with bolts 40*a*, 40*b*, and 40*c*. Bolt 40*c* is inserted through an opening in L-shaped bracket 40, then through an opening in member or beam 10 and typically then through an opening in L-shaped bracket 41 (shown in FIG. 1B), which is aligned with L-shaped bracket 40 (shown in FIG. 1A), and which is on the other side of member or beam 10. A washer and finally a nut, such as of combination washer and nut 41*b* (shown in FIG. 1B) are attached onto the end of bolt 40*c* and screwed on tightly, to hold the L-shaped bracket 40 and its counterpart L-shaped bracket 41 onto the member or beam 10.

Bolt 40*a* is inserted through an opening in L-shaped bracket 40, then through an opening in member or beam 2 and typically then through an opening in the L-shaped bracket 41 (shown in FIG. 1B), which is aligned with L-shaped bracket 40, and which is on the other side of member or beam 2. A washer and finally a nut of combination washer and nut 41*a* are attached onto the end of bolt 40*a* and screwed on tightly, to hold the L-shaped bracket 40 and L-shaped bracket 41 onto the member or beam 2. Bolt 40*b* is inserted through an opening in L-shaped bracket 40, then through an opening in member or beam 2 and typically then through an opening in the L-shaped bracket 41, shown in FIG. 1B, which is aligned with the L-shaped bracket 40, and which is on the other side of member or beam 2. A washer and finally a nut, of washer nut combination 41*c* shown in FIG. 1B are attached onto the end of bolt 40*b* and screwed on tightly, to hold the L-shaped bracket 40 and its counterpart L-shaped bracket 41 onto the member or beam 2. In this manner, the L-shaped bracket 40 and its counterpart L-shaped bracket 41 fix the member or beam 10 to the member or beam 2.

Similarly, the L-shaped bracket 68 may be used to fix the horizontal member or beam 36 to the vertical member or beam 28, along with bolts 68*a*, 68*b*, and 68*c*. Bolt 68*c* is inserted through an opening in L-shaped bracket 68, then through an opening in member or beam 36 and typically then through an opening in L-shaped bracket 69 shown in FIG. 1B, which is aligned with L-shaped bracket 68, and which is on the other side of member or beam 36. A washer and finally a nut of washer nut combination 69*b* are attached onto the end of bolt 68*c* and screwed on tightly, to hold the L-shaped bracket 68 and its counterpart L-shaped bracket 69 shown in FIG. 1B onto the member or beam 36.

Bolt 68*b* is inserted through an opening in L-shaped bracket 68, then through an opening in member or beam 36 and typically then through an opening in the L-shaped bracket 69, shown in FIG. 1B, which is aligned with L-shaped bracket 68 (shown in FIG. 1A), and which is on the other side of member or beam 36. A washer and finally a nut of the washer nut combination 69*a* are attached onto the end of bolt 68*b* and screwed on tightly, to hold the L-shaped bracket 68 and its counterpart L-shaped bracket 69 onto the member or beam 36. Bolt 68*a* is inserted through an opening in L-shaped bracket 68, then through an opening in member or beam 28 and typically then through an opening in the L-shaped bracket 69, shown in FIG. 1B, which is aligned with the L-shaped bracket 68 (shown in FIG. 1A), and which is on the other side of member or beam 28. A washer and finally a nut of combination 69*c* are attached onto the end of bolt 68*a* and screwed on tightly, to hold the L-shaped bracket 68 and its counterpart L-shaped bracket 69 onto the member or beam 28. In this manner, the L-shaped bracket 68 and its counterpart L-shaped bracket 69 fix the member or beam 28 to the member or beam 36.

Similarly, the L-shaped bracket 42 may be used to fix the horizontal member or beam 4 to the vertical member or beam 12, along bolts 43*a*, 43*b*, and 43*c*, and nut and washer combinations 42*a*, 42*c*, and 42*b*. A bolt 43*a* shown in FIG. 1B is inserted through an opening in an L-shaped bracket 43 on the other side of member or beam 4, opposite the side of L-shaped bracket 42. The bolt 43*a* is then inserted through an opening of member or beam 4, and typically then through an opening in L-shaped bracket 42, which is aligned with the L-shaped bracket 43 on the other side of member or beam 4. A washer and finally a nut of combination 42*a*, shown in FIG. 1A, are attached onto the end of the bolt 43*a* and screwed on tightly, to hold the L-shaped bracket 42 and its counterpart L-shaped bracket 43 onto the member or beam 4.

A bolt 43*c* is inserted through an opening in the L-shaped bracket 43 opposite the L-shaped bracket 42 then through an opening in member or beam 4 and typically then through an opening in the L-shaped bracket 42, which is aligned with L-shaped bracket 43, and which is on the other side of member or beam 4. A washer and finally a nut of combination 42*b* are attached onto the end of the bolt of 43*c* and screwed on tightly, to hold the L-shaped bracket 42 and its counterpart L-shaped bracket 43 onto the member or beam 4. A bolt 43*b* is inserted through an opening in the L-shaped bracket 43 (shown in FIG. 1B) opposite L-shaped bracket 42 (shown in FIG. 1A), then through an opening in member or beam 12 and typically then through an opening in the L-shaped bracket 42, which is aligned with the L-shaped bracket 43, and which is on the other side of member or beam 12. A washer and finally a nut of 42*c* are attached onto the end of the bolt of 43*b* and screwed on tightly, to hold the L-shaped bracket 42 and its counterpart 43 onto the member or beam 12. In this manner, the L-shaped bracket 42 and the L-shaped bracket 43 fix the member or beam 12 to the member or beam 4.

Similarly, the L-shaped bracket 70 may be used to fix the horizontal member or beam 38 to the vertical member or beam 30, along with bolts 71*a*, 71*b*, and 71*c*, and nut and washer combinations 70*a*, 70*b*, and 70*c*, respectively. A bolt 71*a* is inserted through an opening in an L-shaped bracket 71 (shown in FIG. 1B) on the other side of member or beam 38 (opposite the side of L-shaped bracket 70, shown in FIG. 1A). The bolt 71*a* is then inserted through an opening of member or beam 38, and typically then through an opening in L-shaped bracket 70, which is aligned with the L-shaped bracket 71 on the other side of member or beam 38. A washer and finally a nut of 70*a* are attached onto the end of the bolt 71*a* and screwed on tightly, to hold the L-shaped bracket 70 and its counterpart L-shaped bracket 71 onto the member or beam 38.

A bolt 71*b* is inserted through an opening in the L-shaped bracket 71, opposite the L-shaped bracket 70, then through an opening in member or beam 38 and typically then through an opening in the L-shaped bracket 70, which is aligned with L-shaped bracket 71, and which is on the other side of member or beam 38. A washer and finally a nut of 70*b* are attached onto the end of the bolt 71*b* and screwed on tightly, to hold the L-shaped bracket 70 and its counterpart L-shaped bracket 71 (shown in FIG. 1B) onto the member or beam 38. A bolt of 70*c* is inserted through an opening in the L-shaped bracket 71 (shown in FIG. 1B), then through an opening in member or beam 30 and typically then through an opening in the L-shaped bracket 70, which is aligned with the L-shaped bracket 71, and which is on the other side of member or beam 30. A washer and finally a nut of 70*c* are attached onto the end of the bolt 71*c* and screwed on tightly, to hold the L-shaped bracket 70 and its counterpart L-shaped bracket 71 onto the member or beam 30. In this manner, the L-shaped bracket 70 and its counterpart, L-shaped bracket 71, fix the member or beam 30 to the member or beam 38.

Each of the bolts, such as bolts 40*a-c*, 68*a-c*, 43*a-c* and 71*a-c*, have a head portion having a width or diameter which prevent the head portion from being inserted into or passing through an opening of a member or beam, and have a pin or threaded portion having a diameter which allows the pin portion to be inserted into and to pass through an opening of a member or beam.

The T-shaped bracket 64 may be used to fix the horizontal member or beam 26 to the vertical member or beam 28, along with bolts 64*a* and 64*b*. Bolt 64*a* is inserted through an opening in T-shaped bracket 64, then through an opening in member or beam 28, then through an opening in T-shaped bracket 65, shown in FIG. 1B. A washer and finally a nut, of combination 65*a* are attached onto the end of bolt 64*a* and screwed on tightly, to hold the T-shaped bracket 64 and its counterpart, T-shaped bracket 65, onto the member or beam 28.

Bolt 64*b* is inserted through an opening in T-shaped bracket 64, then through an opening in member or beam 26, and then through an opening in T-shaped bracket 65, shown in FIG. 1B. A washer and finally a nut of combination 65*b*, are attached onto the end of bolt 64*b* and screwed on tightly, to hold the T-shaped bracket 64, and the T-shaped bracket 65 onto the member or beam 26. In this manner, the T-shaped bracket 64 fixes the member or beam 28 to the member or beam 26.

Similarly, the T-shaped bracket 66 may be used to fix the horizontal member or beam 26 to the vertical member or beam 30, along with bolts 66*a* and a bolt not shown. Bolt 66*a* is inserted through an opening in T-shaped bracket 66, then through an opening in member or beam 30, and then through an opening in T-shaped bracket 67 shown in FIG. 1B. A washer and finally a nut of combination 67*a* are attached onto the end of bolt 66*a* and screwed on tightly, to hold the T-shaped bracket 66 and its counterpart T-shaped bracket 67 onto the member or beam 30.

Another bolt (not shown) is inserted through another opening in T-shaped bracket 66, then through an opening in member or beam 30, and through another opening in T-shaped bracket 67. A washer and finally a nut of combination 67*b*, are attached onto the end of the bolt (not shown) that is inserted through bracket 66, through member 30, and through bracket 67, and screwed on tightly, to hold the T-shaped bracket 66, and the T-shaped bracket 67, onto the member or beam 30. In this manner, the T-shaped brackets 66 and 67 fix the member or beam 26 to the member or beam 30.

The member 6 is fixed to the member 10 by a bolt 10*a*, which is inserted through an opening in the member 10, then through an opening in the member 6 and then a washer and nut combination 10*b*, shown in FIG. 1B, are screwed onto the end of bolt 10*a* and tightened to secure member 6 to member 10. Similarly, the member 6 is fixed to the member 2 by a bolt 2*a*, which is inserted through an opening in the member 2, then through an opening in the member 6, and then a washer and nut combination 2*d* are screwed onto the end of bolt 2*a* and tightened to secure member 6 to member 2.

Similarly, the member 8 is fixed to the member 4 by a bolt 8*d* (shown in FIG. 1B) which is inserted through an opening in the member 4, then through an opening in the member 8 and then a washer and nut of combination 8*a* are screwed onto the end of the bolt 8*d* and tightened to secure member 8 to member 4. Similarly, the member 8 is fixed to the member 12 by a bolt 8*c* shown in FIG. 1B which is inserted through an opening in the member 12, then through an opening in the member 8, and then a washer and nut of combination 8*b* are screwed onto the end of bolt 8*c* and tightened to secure member 12 to member 8.

Similarly, the member 32 is fixed to the member 28 by a bolt 32*a* which is inserted through an opening in the member 28, then through an opening in the member 32 and then a washer and nut 32*b*, shown in FIG. 1B, are screwed onto the end of the bolt 32*a* and tightened to secure member 28 to member 32. Similarly, the member 32 is fixed to the member 36 by a bolt 36*a*, which is inserted through an opening in the member 36, then through an opening in the member 32, and then a washer and nut combination 36*b*, shown in FIG. 1B, are screwed onto the end of bolt 36*a* and tightened to secure member 36 to member 32.

Similarly, the member 38 is fixed to the member 30 by a bolt 34*c* shown in FIG. 1B which is inserted through an opening in the member 30, then through an opening in the member 34 and then a washer and nut of combination 34*b* are screwed onto the end of the bolt of 34*c* and tightened to secure member 30 to member 34. Similarly, the member 34 is fixed to the member 38 by a bolt 38*a* shown in FIG. 1B, wherein the bolt 38*a* is inserted through an opening in the member 38, then through an opening in the member 34, and then a washer and nut combination 34*a* are screwed onto the end of the bolt 38*a* and tightened to secure member 34 to member 38.

The member or beam 14 is fixed, perpendicularly or substantially perpendicularly, to the member or beam 2 via bolt 14*a* and nut 14*b*, and to the member or beam 4 via bolt 14*c* and nut 14*d*. The bolt 14*a* is inserted through an opening of the beam 14 and through an opening of the member of beam 2, and then the nut 14*b* is screwed and tightened onto the end of bolt 14*a*. The bolt 14*c* is inserted through an opening of the beam 14 and through an opening of the member of beam 4, and then the nut 14*d* is screwed onto the end of bolt 14*c*.

The member or beam 14 includes hooks 44 and 46 which have a straight portion and a hooked portion. The hooks 44 and 46 are fixed to the member or beam 14, by for example, nuts and bolts not shown, so that the straight portions of the hooks 44 and 46 are perpendicular or substantially perpendicular to the member or beam 14.

The member 10 can slide up and down or telescope (for height adjustment) within a cavity or chamber of the member 28 unless it is fixed, such as in FIG. 1, where member 10 is fixed to member 28 by bolts 28*a*, 28*b*, and nuts 28*c*, and 28*d*. Bolt 28*a* is inserted through an opening in member 28 then through an opening in member 10 and then through another opening of member 28 and nut 28*c* is screwed onto bolt 28*a* and tightened to fix member 10 with respect to member 28. Similarly, bolt 28*b* is inserted through an opening in member 28, then through an opening in member 10 and then through another opening of member 28 and nut 28*d* is screwed onto bolt 28*b* and tightened to additionally support and fix member 10 with respect to member 28.

Similarly, the member 12 can slide up and down or telescope (for height adjustment) within a cavity or chamber of the member 30 unless it is fixed, such as in FIG. 1, where member 12 is fixed to member 30 by bolts 30*a*, 30*b*, and nuts 30*c*, and 30*d*. Bolt 30*a* is inserted through an opening in member 30 then through an opening in member 12 and then through another opening of member 30 and nut 30*c* is screwed onto bolt 30*a* and tightened to fix member 12 with respect to member 30. Similarly, bolt 30*b* is inserted through an opening in member 30, then through an opening in member 12 and then through another opening of member 30 and nut 30*d* is screwed onto bolt 30*b* and tightened to additionally support and fix member 12 with respect to member 30

Member 20 lies partially outside a hollow cavity or chamber of member 18 as shown in FIG. 1A, and partially inside the member 18. Member 20 can be fixed at a location relative to the member 18 by handle 60, a bolt of handle 60, and nuts 60*a-b*. When handle 60 is taken out of members 18 and 20, the member 20 can slide or telescope within the member 18 until it is stopped by nut and bolt combination 16*a-c* in the outer direction D2 shown in FIG. 10, or stopped by the beam 21 in the direction D3. Member 20 can be fixed by handle 60 so that different percentages or portions of member 20 lie outside and inside of the member 18. For example, FIG. 1A, shows less of member 20 lying outside of the member 18 than in the state of FIG. 10. FIG. 1A has more of member 20 lying inside of the member 18 than in the state of FIG. 10.

Similarly, member 21 lies partially outside a hollow cavity or chamber of member 18 as shown in FIG. 1A, and partially within member 18. Member 21 can be fixed at a location relative to the member 18 by handle 62, a bolt of handle 62, and nuts 62*a-b*. When handle 62 is taken out of members 18 and 21, the member 21 can slide or telescope within the member 18 until it is stopped by nut and bolt combination 16*d-f* in the outer direction D3 shown in FIG. 10, or stopped by the beam 20 in the direction D2. Member 21 can be fixed by handle 62 so that different percentages or portions of member 21 lie outside and inside of the member 18. For example, FIG. 1A, shows less of member 21 lying outside of the member 18 than in the state of FIG. 10. FIG. 1A has more of member 21 lying inside of the member 18 than in the state of FIG. 10.

Handles 56 and 58 are fixed, substantially perpendicular or completely perpendicular to the member 20, such as by nuts and bolts. The handles 56 and 58 may be made of a rigid material, such as metal with a plastic cover or coating. Each of hooks 48, 50, 52, and 54 may have a straight portion and a hooked portion. Each of hooks 48, 50, 52, and 54 may be fixed so that the straight portions are substantially perpendicular or completely perpendicular to the member 20, such as by nuts and bolts. The hooks 48, 50, 52, and 54 may be made of strong, rigid metal, such as steel, having a high strength such as the hooks 48, 50, 52, and 54 may hold loads of a thousand or more pounds each.

The apparatus may further include handles 60 and 62 which may be fixed substantially perpendicular to, or completely perpendicular to the beams 18 and 16, by bolt or bolt and nut 60*a* and nut 60*b* (handle 60 to beams 16 and 18) and bolt or bolt and nut 62*a* and nut 62*b* (handle 62 to beams 16 and 18). The beam 18 may be fixed on top of the beam 16 by U-bolt 72, plate 72*b*, and nuts 72*a* and 72*c*, as well as U-bolt 74, plate 74*b*, and nuts 74*a* and 74*c*.

The member or beam 16 may be fixed, perpendicularly or substantially perpendicularly to the member or beam 22 via nuts 16*a* and 16*b*, and bolt 16*c*. The member or beam 16 may be fixed, perpendicularly or substantially perpendicularly to the member or beam 24 via nuts 16*d* and 16*e*, and bolt 16*f*.

Figure 2:
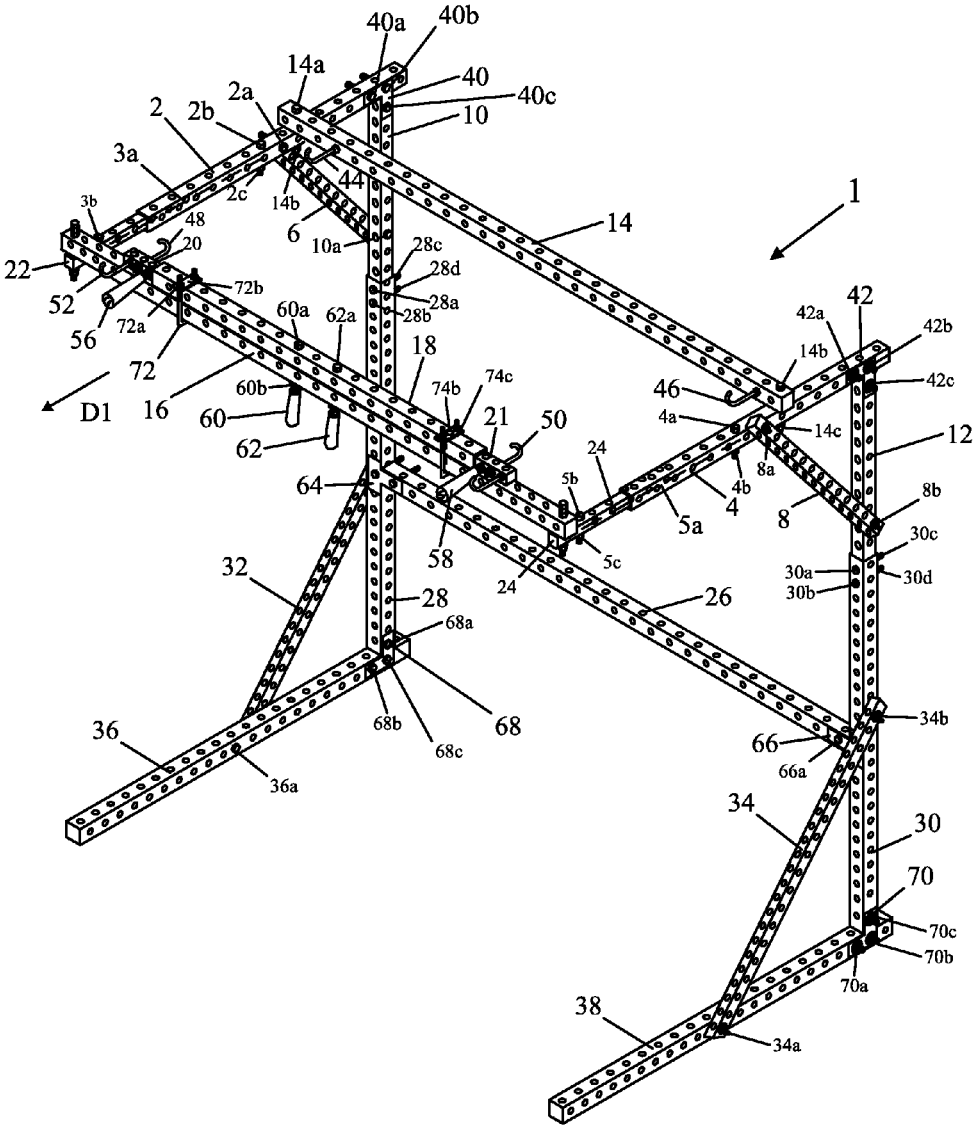
FIG. 2 shows a front, right side, top perspective view of the apparatus of FIG. 1A, with the apparatus shown in a second state.

The member 22 can slide or telescope within a hollow chamber of the member 2 and the member 24 can slide or telescope within a hollow chamber of the member 4 to allow the apparatus 1 to be changed from a first state shown in FIG. 1A to a second state shown in FIG. 2. In at least one embodiment of the present invention the devices 100 and 120 (for barbell 200 use), and the devices 400, 420, 440, and 460 (for use of dumbbells 500 and 520) may remain attached to the apparatus 1 at the same time, and barbell 200, dumbbell 500, and dumbbell 520 may be inserted and/or held up by devices 100 and 120, devices 400 and 420, and devices 440 and 460, respectively, at the same time. The sliding or telescoping of members 22 and 24 allows an individual to move devices 400, 420, 440, and 460 (and dumbbells 500 and 520) shown in FIGS. 7A and 7B out of the way (more toward the feet of the individual i.e. in the direction D1 of FIG. 1A), but to leave the devices 400, 420, 440, and 460 connected to the apparatus 1, while also having the devices 100 and 120 connected to the apparatus 1. By sliding the members 22 and 24 in the direction D1 shown in FIG. 1A, until the apparatus 1 is in the state of FIG. 2, the devices 400, 420, 440, and 460 and the dumbbells 500 and 520 are moved out of the way so that the barbell 200 (and devices 100 and 120) can be used. The handles 60 and 62 can gripped by a person, and the handles 60 and 62 can be pulled in the direction D1, shown in FIG. 1A, to slide the members 22 and 24 out in the direction D1 to change the apparatus 1 from the state of FIG. 1A to FIG. 2.

The handles 56 and 58 can be gripped by an individual to do pull-ups or a lateral press.

Bolt 2*b* and nut 2*c*, and bolt 4*a* and not 4*b* may be provided as stops to prevent the members or beams 22 and 24 from sliding too far into the members or beams 2 and 4, during assembly. Bolt 2*b* is inserted into and through an opening in member 2 and nut 2*c* is screwed and tightened onto the end of bolt 2*b*. Bolt 4*a* is inserted into and through an opening of the member 4 and nut 4*b* is screwed and tightened onto the end of bolt 4*a*.

A chain, wire, or cord 3*a* is shown as a curved broken line in FIGS. 1A and 1B. The chain wire or cord 3*a* lies within a hollow chamber of the beam 2. Similarly, a chain, wire, or cord 5*a* is shown as a curved broken line in FIGS. 1A and 1B. The chain wire or cord 5*a* lies within a hollow chamber of the beam 4. Typically, the chains, wires, or cords 3*a* and 5*a* can only be seen partially through the circular openings in the beams 2 and 4, since the chains 3*a* and 5*a* lie within the beams 2 and 4, respectively. However, in FIGS. 1A and 1B, the chains 3*a* and 5*a* have been shown as broken curved lines so that they can be more easily identified. The chains 3*a* and 5*a* are attached and fixed, at a first end, to pin portions of bolts 2*b* and 4*a*, within the beams 2 and 4, respectively. The chains 3*a* and 5*a* are attached and fixed, at a second end of the chains 3*a* and 5*a* opposite their first ends, to pin portions of the bolts 3*b* and 5*b*, which are fixed to beams 22 and 24, respectively. The chains 3*a* and 5*a* prevent the beams 22 and 24, from being pulled completely out of the beams 2 and 4, respectively, in the direction D1 shown in FIG. 1A. The chains 3*a* and 5*a* are shown, as curved dashed lines in FIG. 1A to show that there is slack in the chains 3*a* and 5*a*. The chains 3*a* and 5*a* are shown as straight dashed lines in FIG. 2 to show there is no slack in chains 3*a* and 5*a* and the chains 3*a* and 5*a* in FIG. 2, prevent the beams 22 and 24 from being pulled out of the beams 2 and 4, respectively, any further in the direction D1.

Figure 3:
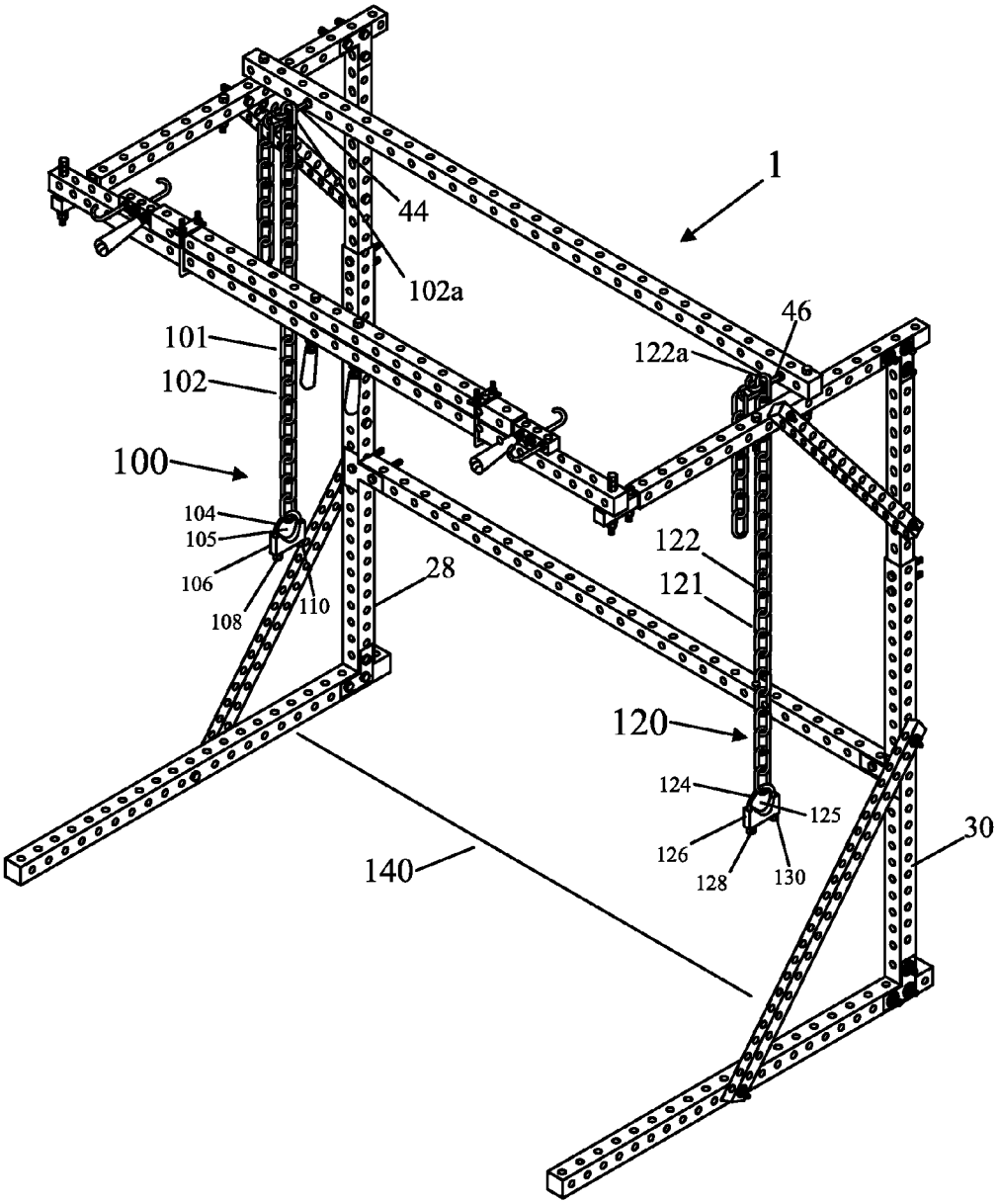
FIG. 3 shows a front, right side, top perspective view of the apparatus of FIG. 1A, with the apparatus shown in the first state, and with two devices for holding first and second ends of a weightlifting barbell.

FIG. 3 shows a front, right side, top perspective view of the apparatus 1 in accordance with an embodiment of the present invention, with the apparatus 1 shown in the first state, and with a device 100 and a device 120 for holding first and second ends, respectfully, of a weightlifting barbell. The devices 100 and 120 may be identical. The device 100 may include a plurality of chain links 102 of a chain 101, a U-bolt 104, a metal retainer device 106, and nuts 108 and 110. Similarly the device 120 may include a plurality of links 122 of a chain 121, a U-bolt 124, a metal retainer device 126, and nuts 128 and 130. The U-bolt 104 and the retainer device 106 form a substantially circular or circular opening 105 into which a first end of a weightlifting barbell can be inserted. The U-bolt 124 and the retainer device 126 form a substantially circular or circular opening 125 into which a second end, opposite the first end, of a weightlifting barbell can be inserted.

In FIG. 3, the device 100 is attached to the hook 44 through the link 102*a* of the links 102 of device 100, while the device 120 is attached to the hook 46 through the link 122*a* of the links 122 of the device 120. The devices 100 and 120 may be connected or attached to the hooks 44 and 46 so that the U-bolt 104 and retainer device 106 are at the same vertical height, or substantially the same vertical height with respect to ground and typically with respect to the vertical member 28, as the U-bolt 124 and the retainer device 126 are with respect to ground 140 and with respect to the vertical member 30.

Figure 4:
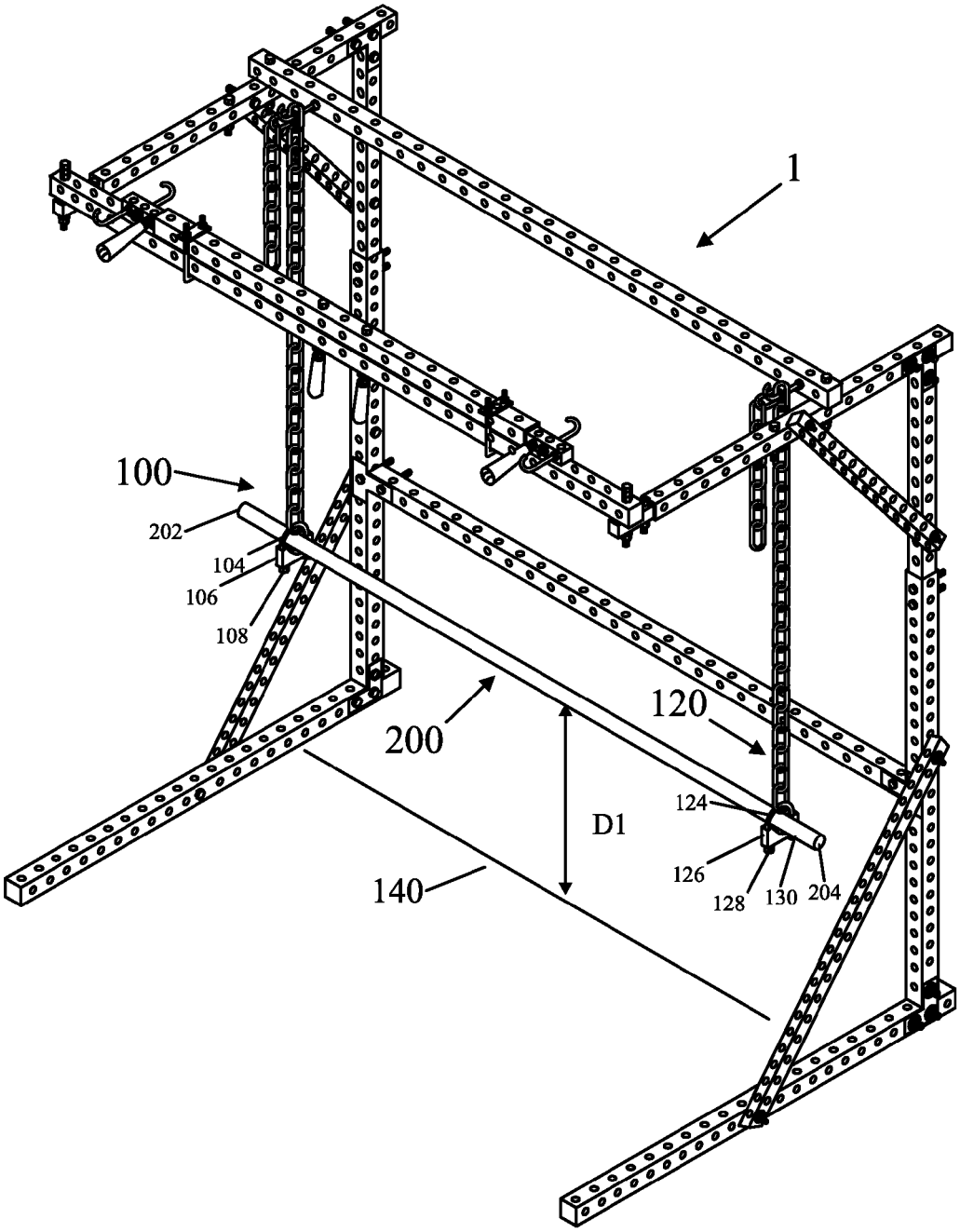
FIG. 4 shows a front, right side, top perspective view of the apparatus of FIG. 1A, with the apparatus shown in the first state, along with the two devices for holding first and second ends, respectfully, of a weightlifting barbell, and along with a barbell.

FIG. 4 shows a front, right side, top perspective view of the apparatus 1 in accordance with an embodiment of the present invention, with the apparatus 1 shown in the first state, and with the device 100 and the device 120 for holding first and second ends, respectfully, of a weightlifting barbell, and with a barbell 200. The barbell has ends 202 and 204. The end 202 has been inserted through the opening 105 and the end 204 has been inserted through the opening 125, so that the barbell 200 is now supported in mid air a distance D1 a ground surface 140.

Figure 5:
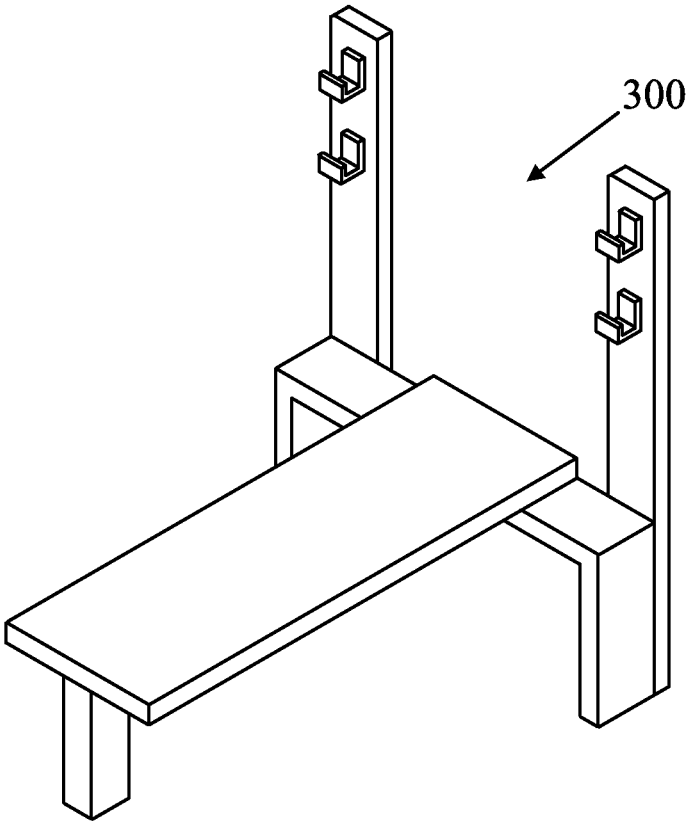
Fig. 5 (Prior Art)
FIG. 5 shows a front, right side, top perspective view of a weightlifting bench in accordance with the prior art.

FIG. 5 shows a front, right side, top perspective view of a weightlifting bench 300 in accordance with the prior art. The bench 300 may be replaced by any weightlifting bench known in the art.

Figure 6A:
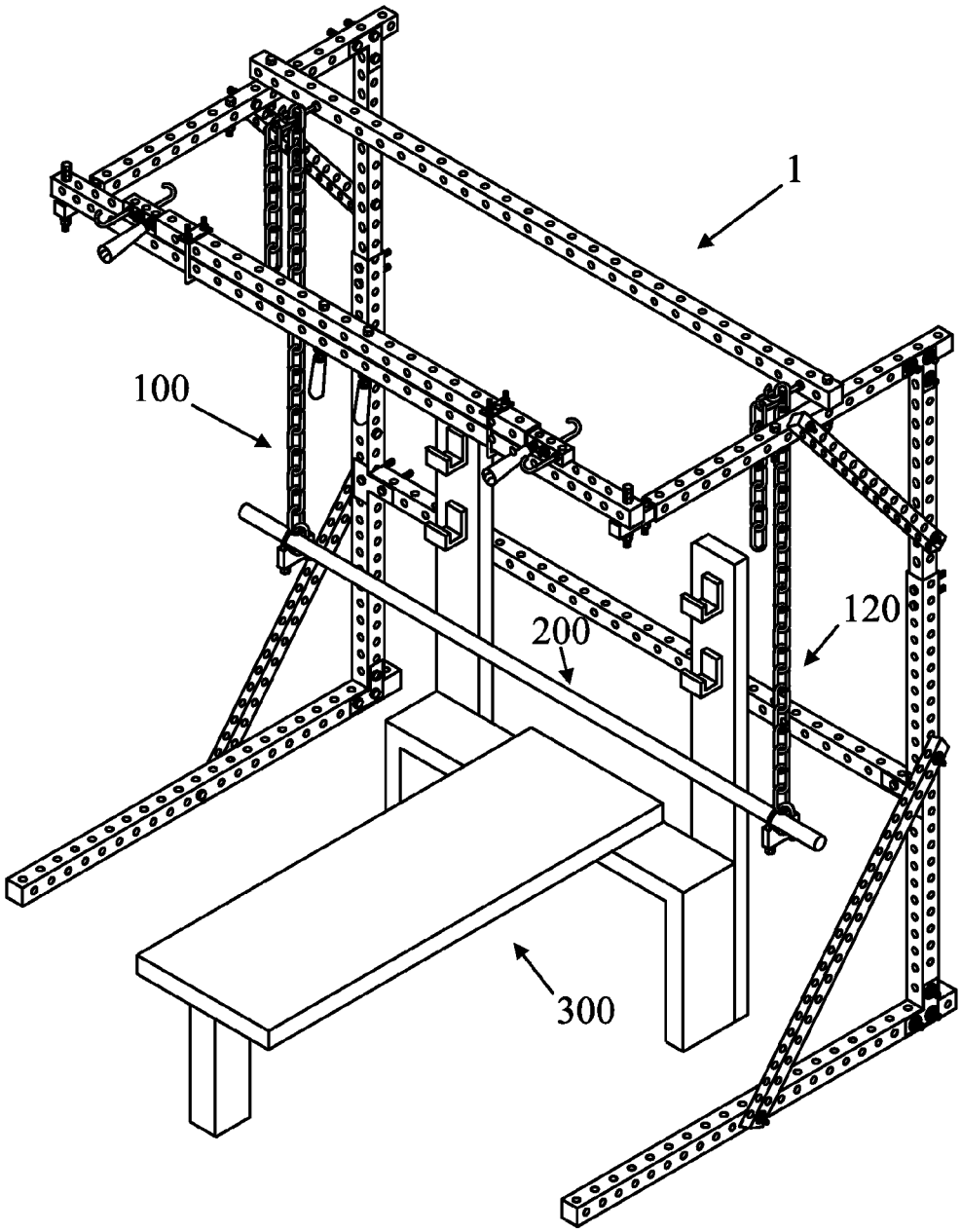
FIG. 6A shows a front, right side, top perspective view of the apparatus of FIG. 1A in accordance with an embodiment of the present invention, with the apparatus of FIG. 1A shown in the first state, and with the two devices for holding first and second ends, respectfully, of a weightlifting barbell, with the barbell, and with the bench shown placed so that an individual can bench press the barbell and any attached weights.

FIG. 6A shows a front, right side, top perspective view of the apparatus 1 in accordance with an embodiment of the present invention, with the apparatus 1 shown in the first state, and with the device 100 and the device 120 for holding first and second ends, respectfully, of a weightlifting barbell, with the barbell 200, and with the bench 300 shown placed so that an individual can bench press the barbell 200 and any attached weights. The devices 100 and 120 prevent the barbell 200 from falling onto a person's chest and injuring the person.

Figure 6B:
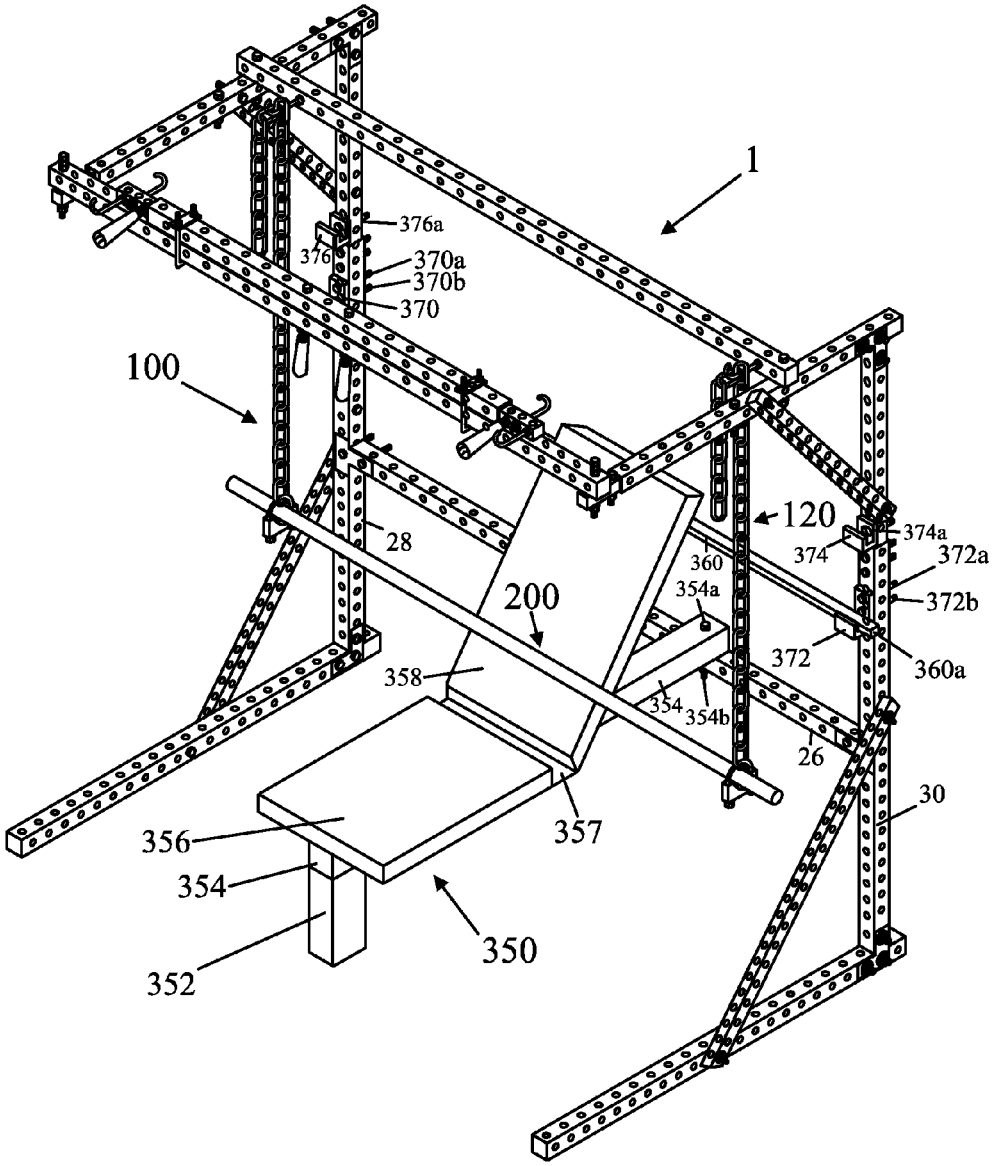
FIG. 6B shows a front, right side, top perspective view of the apparatus of FIG. 1A in accordance with an embodiment of the present invention, with the apparatus of FIG. 1A shown in the first state, and with the two devices for holding first and second ends, respectfully, of a weightlifting barbell, with the barbell, and with an inclined bench attached to the apparatus of FIG. 1A, and placed so an individual can do an inclined press and any attached weights.

FIG. 6B shows a front, right side, top perspective view of the apparatus 1 in accordance with an embodiment of the present invention, with the apparatus 1 shown in the first state, and with the device 100 and the device 120 for holding first and second ends, respectfully, of a weightlifting barbell, with the barbell 200, and with an incline bench 350 shown placed so that an individual can bench press the barbell 200 and any attached weights, from a position, in which the individual's back is inclined. The devices 100 and 120 prevent the barbell 200 from falling onto the person and injuring the person. In accordance with an embodiment of the present invention, the inclined bench 350 includes a base 352, and an extension 354. The base and the extension 354 may be made of rigid metal, such as steel and may be capable of holding a thousand pounds or more. The extension 354 may be perpendicular or substantially perpendicular to the base 352. The extension 354 may be attached and fixed to the beam 26 by an attachment device such as including bolt 354*a* and nut 354*b*. The bolt 354*a* may be inserted through an opening in the beam 26 and then may be held and fixed to the beam 26 by the nut 354*b*. The inclined bench 350 may include flat fixed portion 356, which may be fixed to extension 354, and adjustable portion 358 which may be rotatably fixed to the portion 356 by a hinge 357.

An incline bar 360, such as a rigid steel bar, capable of holding a thousand pounds or more, may be placed or fixed on the apparatus 1. For example, the incline bar 360 may have one end 360*a* inserted into a U or L-shaped bracket 372 which is fixed to the beam 30 by bolt and nut combinations 372*a* and 372*b* and an end opposite end 360*a* (not shown) inserted into a U or L-shaped bracket 370 which is fixed to the beam 28 by bolt and nut combinations 370*a* and 370*b*. Thus end 360*a* of the incline bar 360 would be supported by bracket 372 while at the same time the end opposite 360*a* would be supported by bracket 370. One end of the adjustable (or inclined) portion 358 of the bench 350 may be supported by the inclined bar 360 as shown in FIG. 6B. The inclined bar 360 can be removed, the U or L-shaped brackets 370 and 372 can be taken off of the beams 30 and 28 (by unscrewing appropriate nuts and bolts) and moved to a different height, so that the incline angle of portion 358 with respect to portion 356 can be changed.

U or L-shaped brackets 374 and 376, may be removably fixed at different heights on beams 28 and 30 by nuts and bolts 374*a* and 376*a*, as may be appropriate.

Figure 7A:
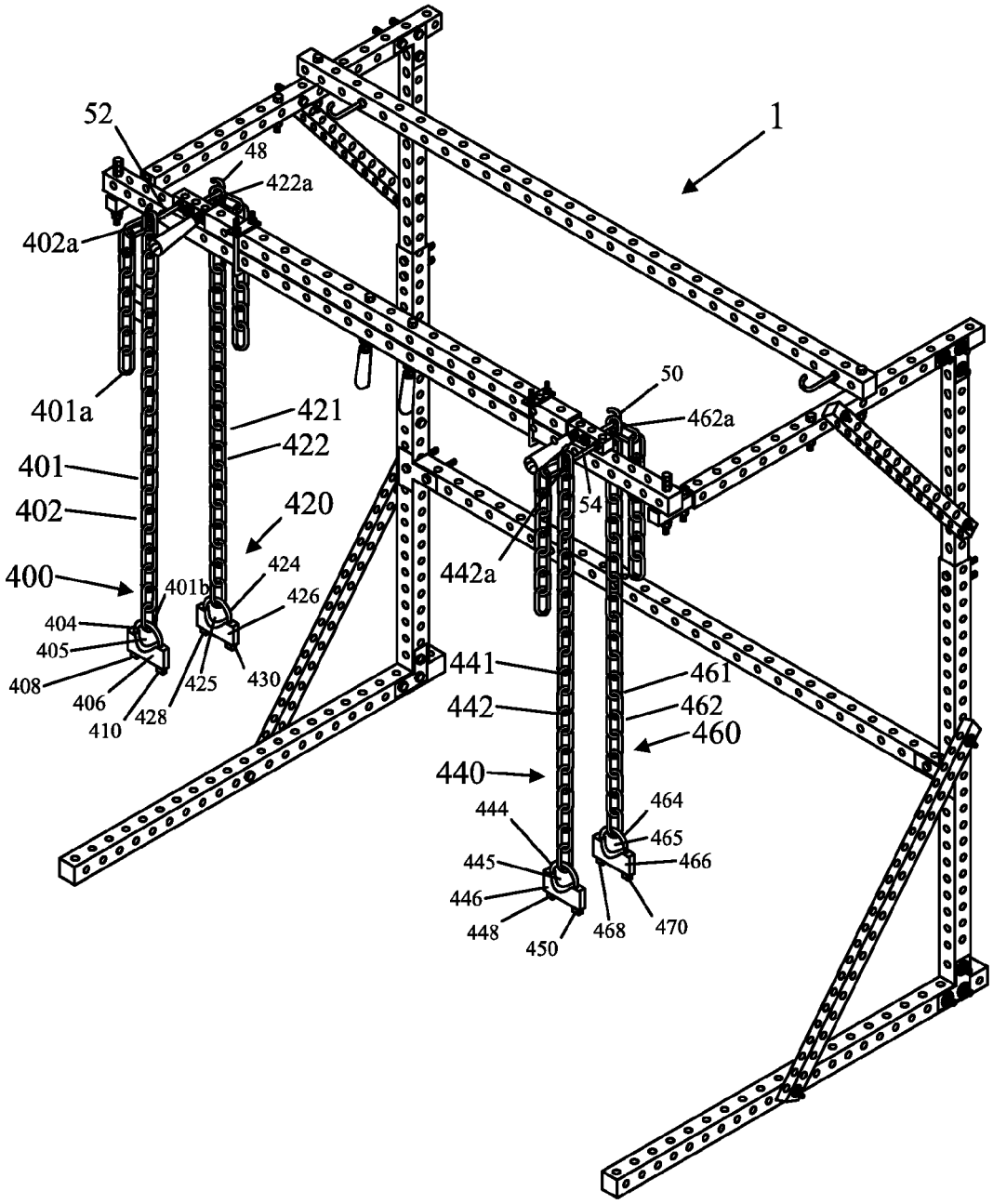
FIG. 7A shows a front, right side, top perspective view of the apparatus of FIG. 1A in accordance with an embodiment of the present invention, with the apparatus of FIG. 1A shown in the first state, and with the four devices, two for holding the ends of a first dumbbell and two for holding the ends of a second dumbbell.

FIG. 7A shows a front, right side, top perspective view of the apparatus 1 of FIG. 1 in accordance with an embodiment of the present invention, with the apparatus 1 of FIG. 1 shown in the first state, and with the four devices 400, 420, 440, and 460. Each of the four devices 400, 420, 440, and 460 may be identical to each other and to each of the devices 100 and 120 shown in FIG. 6.

The device 400 includes a chain 401 having a plurality of chain links 402. Chain link 402*a* of the chain links 402 is shown placed on the hook 52, so the hook 52 supports the device 400. The device 400 also includes U-bolt 404 and retaining device 406, which form an opening 405. Nuts 408 and 410 are attached onto ends of U-bolt 404 to hold the retaining device 406 onto U-bolt 404.

Similarly, the devices 420, 440, and 460 have chains 421, 441, and 461; plurality of chain links 422, 442, 462; U-bolts 424, 444, and 464; retaining devices 426, 446, and 466; nuts 428, 448, and 468; and nuts 430, 450, and 470, respectively. The U-bolts 424, 444, and 464 and the retaining devices 426, 446, and 466 define openings 425, 445, and 465, respectively, which may be circular or substantially circular. The devices 420, 440, and 460 are hung from hooks 48, 54, and 50, by links 422*a*, 442*a*, and 462*a*, respectively.

The chains 401, 421, 441, and 461 may made of steel, or other rigid, strong material, and may be capable of holding a thousand or more pounds. The retaining devices 406, 426, 446, and 466 may be made of steel, or another strong rigid material, and may be capable of holding a thousand or more pounds.

Figure 7B:
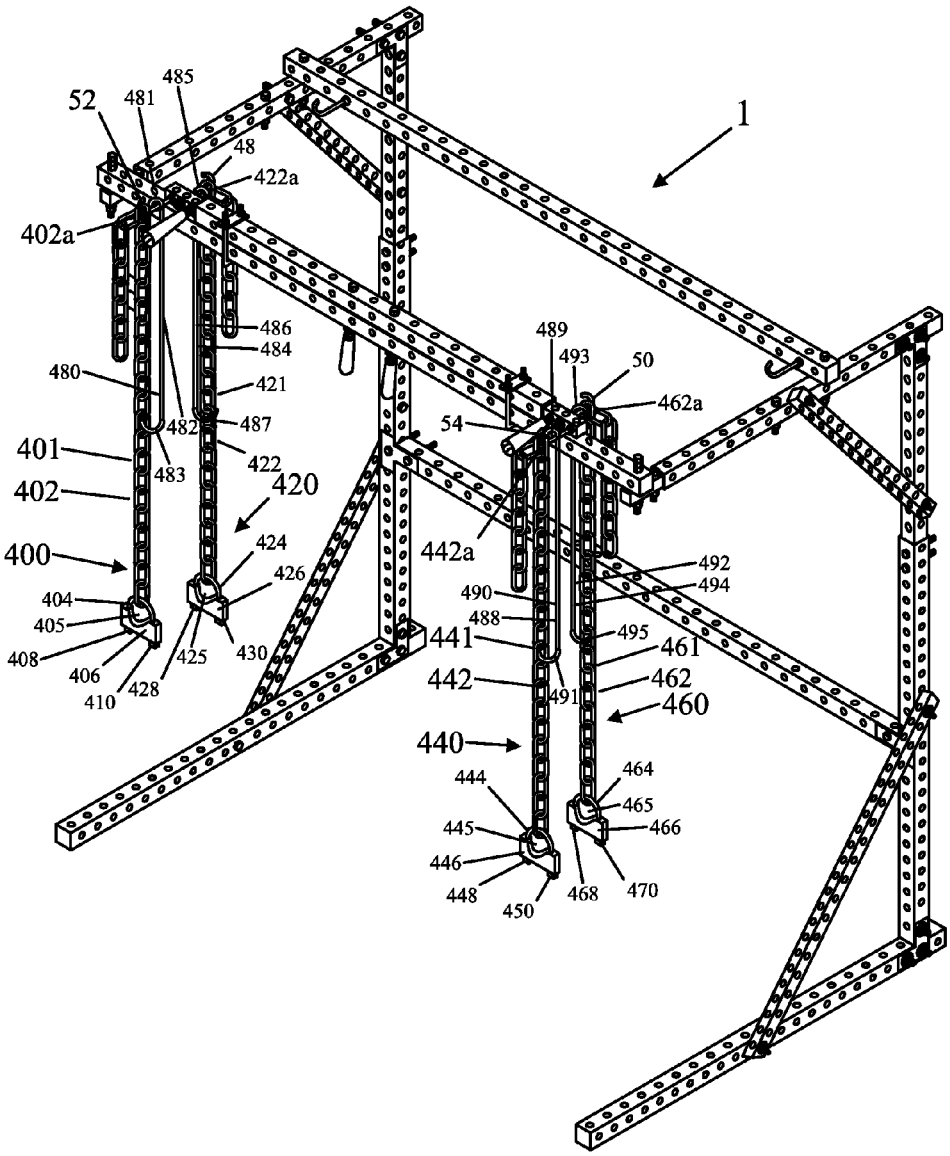
FIG. 7B shows a front, right side, top perspective view of the apparatus of FIG. 1A in accordance with an embodiment of the present invention, with the apparatus of FIG. 1A shown in the first state, and with the four devices, two for holding the ends of a first dumbbell and two for holding the ends of a second dumbbell, and with elastic cord devices attached to hooks of the apparatus of FIG. 1A.

FIG. 7B shows a front, right side, top perspective view of the apparatus 1 of FIG. 1 in accordance with an embodiment of the present invention, with the apparatus 1 of FIG. 1 shown in the first state, and with the four devices 400, 420, 440, and 460. In addition, FIG. 7B also shows chain restraining devices 480, 484, 488, and 492, each of which may be or may be simliar to a bungee cord.

Chain restraining devices 480, 484, 488, and 492 include first hooks 481, 485, 489, and 493, elastic cords 482, 486, 490, and 494, and second hooks 483, 487, 491, and 495, respectively. The first hooks 481, 485, 489, and 493 are attached to hooks 52, 48, 54, and 50, respectively. The second hooks 483, 487, 491, and 495 are attached to a link, such as a substantially central link of the chains 401, 421, 441, and 461, respectively. The chain restraining devices 480, 484, 488, and 492 are sized and attached so that when dumbbells, such as dumbbells 500 and 520 of FIG. 8, are picked up in the direction U shown in FIG. 8, slack which would normally form in the chains 401, 421, 441, and 461 is picked up by the devices 480, 484, 488, and 492, to keep the slack from getting into a weightlifter's way as he or she picks up the dumbbells in the direction U.

Figure 8:
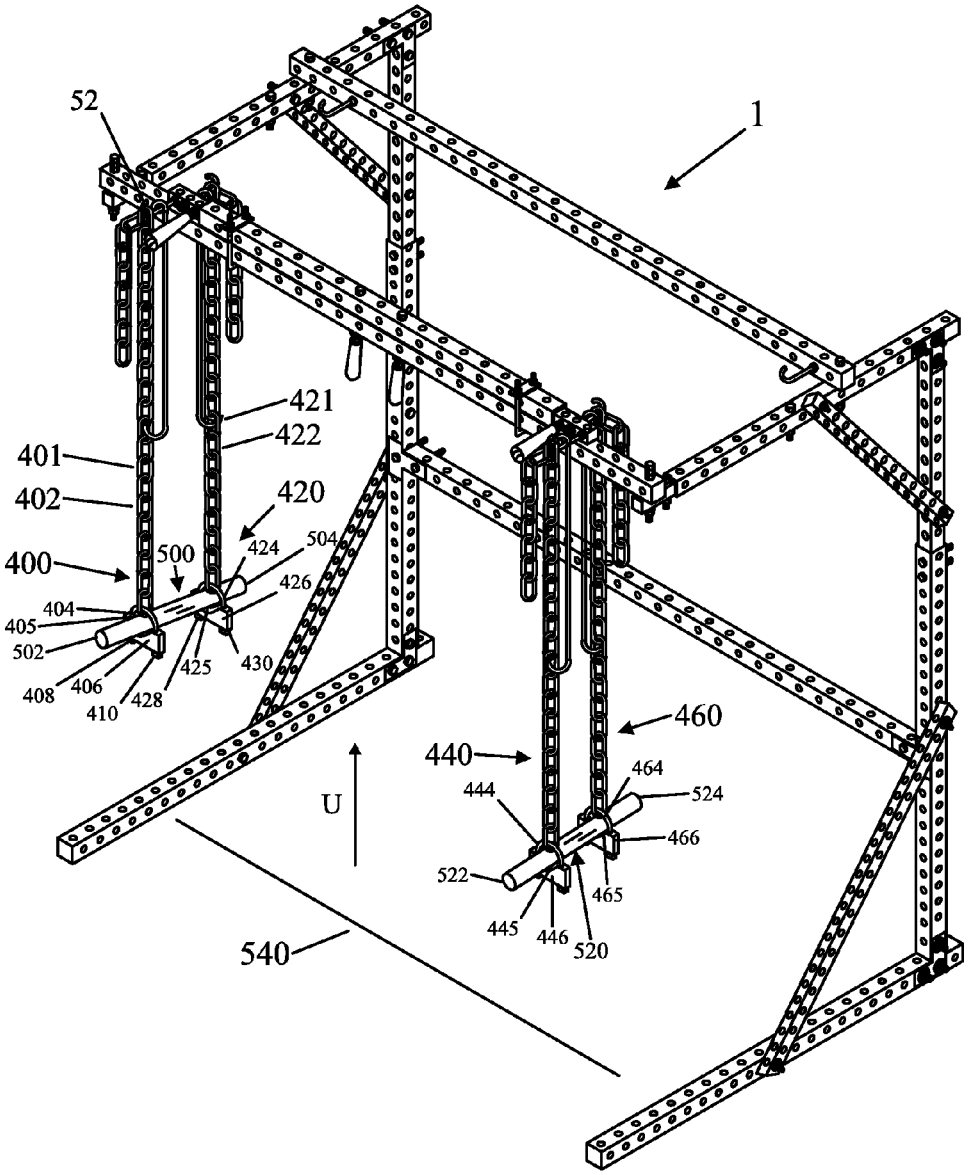
FIG. 8 shows a front, right side, top perspective view of the apparatus of FIG. 1A in accordance with an embodiment of the present invention, with the apparatus of FIG. 1A shown in the first state, with the four devices, two for holding the ends of a first dumbbell and two for holding the ends of a second dumbbell, and with first and second dumbbells shown.

FIG. 8 shows a front, right side, top perspective view of the apparatus 1 of FIG. 1 in accordance with an embodiment of the present invention, with the apparatus 1 of FIG. 1 shown in the first state, with the four devices 400, 420, 440, and 460, and with first and second dumbbells 500 and 520 shown. The dumbbells 500 and 520 may be identical to each other. The dumbbell 500 includes ends 502 and 504. End 502 is shown inserted through the opening 405, while end 504 has been simultaneously inserted through the opening 425. In this manner the dumbbell 500 may be held in midair by the devices 400 and 420. The devices 400 and 420 typically are set at the same vertical height off of the ground 540 so that dumbbell 500 will be parallel or substantially parallel to the ground 540.

Similarly, the dumbbell 520 includes ends 522 and 524. End 522 is shown inserted through the opening 445, while end 524 has been simultaneously inserted through the opening 465. In this manner the dumbbell 520 may be held in midair by the devices 440 and 460. The devices 440 and 460 typically are set at the same vertical height off of the ground 540 so that dumbbell 520 will be parallel or substantially parallel to the ground 540.

The left side of the apparatus 1 shown in FIG. 1A is typically the same as the right side of the apparatus 1, i.e. the apparatus 1 is symmetrical from left to right and right to left.

Figure 9:
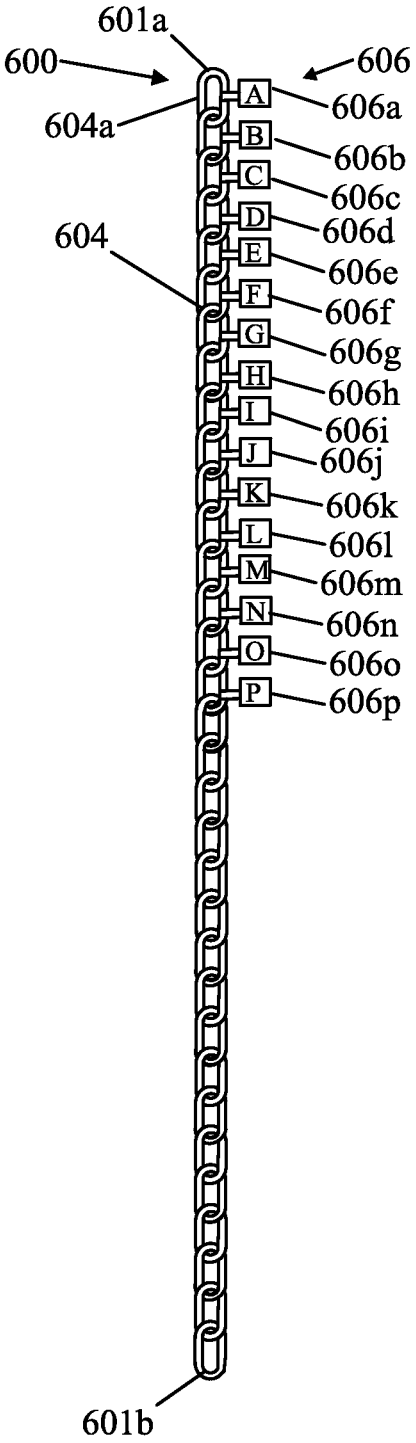
FIG. 9 shows a front view of a chain for use in accordance with another embodiment of the present invention.

FIG. 9 shows a front view of a chain 600 for use in accordance with another embodiment of the present invention. Each of the chains 101, 121, 401, 421, 441, and 461 may be replaced with or may be identical to the chain 600. The chain 600 has an end 601*a* and an opposite end 601*b*. The end 601*b* may be attached to a component, such as one of 104-106, 124-126, 404-406, 424-426, 444-446, and 464-466.

The chain 600 includes a plurality of chain links 604 including link 604*a*. Each of a plurality of links starting from the end 601*a*, has a tag. Each tag may have a letter designation or number designation to indicate a level or height for setting the chain 600. For example letter or number designations A-P may be placed on tags 606*a*-606*p*, respectively. The letter or number designations may be in numerical or alphabetical order. A user can, for example, place and attach the chain link corresponding to tag 606*f* "F" onto the hook 52 to set a device, such as device 404-406 for holding a barbell or dumbbell) to a vertical height off of the ground 540 of FIG. 8. A user can remember the appropriate setting (such as tag 606*f* "F") and the next time that user uses the apparatus 1 (say the next day or the next week, after many other intervening users may have changed the setting), the user may reset the chain 600 to the tag 606*f* "F" height setting.

Referring to FIG. 4, weight lifting collars may be placed the barbell 200 on both inner and outer sides of the retainer device 106, and on both inner and outer sides of the retainer device 126 to maintain the retainer devices 106 and 126 in a fixed position with respect to the barbell 200 and to prevent the barbell 200 from sliding off of the retainer devices 106 and 126.

Similarly, referring to FIG. 8 weight lifting collars may be placed on the dumbbell 500 on both inner and outer sides of the retainer devices 406 and 426, and on dumbbell 520 on both inner and outer sides of the retainer devices 446 and 466 to maintain the retainer devices 406 and 426 in a fixed position with respect to the dumbbell 500, and to maintain the retainer devices 446 and 466 in a fixed position with respect to the dumbbell 520, and to prevent the dumbbells 500 and 520 from sliding off of the respective retainer devices.

The chains 101 and 121 shown in FIG. 3, and the chains 401, 421, 441, and 461 shown in FIG. 7A may each be an example of a flexible device. Each of the chains 101, 121, 401, 421, 441, and 461 may be replaced by a cord or other type of flexible device. The chains 101, 12, 401, 421, 441, and 461 may be made of rigid, strong metal, such as iron or steel, capable of holding a thousand pounds or more. Each of the U-bolts 104, 124, 404, 424, 444, and 464, the bolts 408, 410, 428, 430, 448, 450, 468, and 470, as well as the retainer devices 406, 426, 446, and 466 may be made of rigid strong metal, such as iron or steel, capable of holding a thousand pounds or more.

Figure 10:
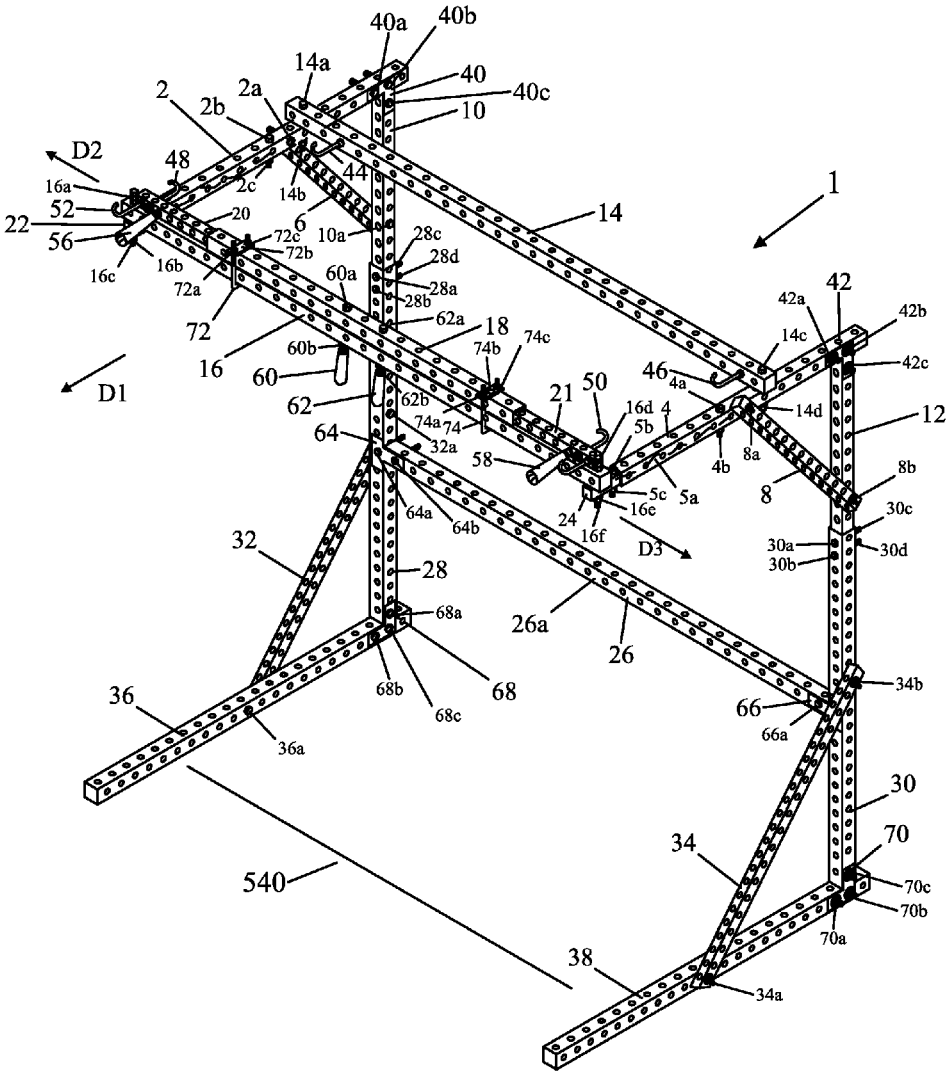
FIG. 10 shows a front, right side, top perspective view of the apparatus of FIG. 1A, with the apparatus shown in a third state.

FIG. 10 shows a front, right side, top perspective view of the apparatus 1 of FIG. 1A, with the apparatus 1 shown in a third state. The beam 20 has been pulled outwards from the beam 18 in the direction D2 from the state or position shown in FIG. 1A to the state or position shown in FIG. 10. In the state or position shown in FIG. 1A, the handle 56 is closer to the beam 18 than in the state or position of FIG. 10. In addition, the beam 21 has been pulled outwards from the beam 18 in the direction D3 from the state or position shown in FIG. 1A to the state or position shown in FIG. 10. In the state or position shown in FIG. 1A, the handle 58 is closer to the beam 18 than in the state or position of FIG. 10. The beam 20 can be moved outwards in the direction D2 by pulling the handle 56 in the direction D2, which is typically parallel or substantially parallel to the ground 540 and perpendicular or substantially perpendicular to the beams 28 and 30. The beam 21 can be moved outwards in the direction D3 by pulling the handle 58 in the direction D3, which is opposite the direction D2 and which is typically parallel to the ground 540 and perpendicular or substantially perpendicular to the beams 28 and 30. The beams 20 and 21 are prevented from going any further outwards than shown in FIG. 10, in the directions D2 and D3, by the bolt(s) and nuts 16*a-c* and 16*d-e*, respectively. The handles 56 and 58 and the handles 60 and 62, and nuts 60*a-b*, and 62*a-b*, prevent the beams 20 and 21 from going further inward into the beam 18, than the position shown in FIG. 1A.

The state of FIG. 1A, with the beams 20 and 21 in the positions shown relative to the beam 18, can be used to locate dumbbells 500 and 520 as shown in FIG. 8, so that they would be closer to a torso or chest of a person for a specific exercise such as a dumbbell press. The state of FIG. 10, with the beams 20 and 21 in the positions shown relative to the beam 18 (i.e. with the hooks 52 and 48 and 58 and 50 outwards further from the center of the beam 18) can be used to locate dumbbells 500 and 520 so that they would be farther from a torso or chest of a person for a different exercise, such as a dumbbell flies. Thus, sliding the beams 20 and 21 with reference to the beam 18 sets the hooks 52, 48, 58, and 50 at different positions for different exercises.

The beam 20 can be fixed in a position or state relative to the beam 18, by inserting a bolt of handle 60 through a hole in beam 16, then into a hole in beam 18, then through a hole in beam 20, out of beam 20, and then out from the hole in beam 18, and then secured with nut 60*a*. Similarly, the beam 21 can be fixed in a position or state relative to the beam 18, by inserting a bolt of handle 62 through a hole in beam 16, then into a hole in beam 18, then through a hole in beam 21, out of beam 21, and then out from the hole in beam 18, and then secured with nut 62*a*.

The beam 22 may be fixed inside of the beam 2 by the bolt 2*b* and the bolt 2*c* shown in FIG. 1A. The beam 24 may be fixed inside of the beam 4 by the bolt 4*a* and the nut 4*b*.

Instead of bolts and nuts, beams may be connected to each other in other ways. For example, the beam 22 may be held in a position with respect to the beam 2 by a removable pin in place of the bolt 2*b* and the nut 2*c*. Similarly the beam 24 may be held in position with respect to the beam 4 by a removable pin in place of the bolt 4*b* and the nut 2*c*. A pin holding beam 22 (in place of bolt 2*b*) and a pin holding beam 24 (in place of bolt 4*a*) may taken out and then the beam 22 and the beam 24 can be slid in the direction D1 from the state of FIG. 1A to the state of FIG. 2. This may be said to increase the length of a top structure of the overall rigid frame structure of the apparatus 1, wherein the top structure may include beams 2, 4, 14, 16, 18, 20, 21, 22, and 24. Similarly the handles 60 and 62 and nuts and bolts 60*a-b*, 62*a*0*b* may be replaced with pins, which can be taken out to allow the beams 20 and 21 to slide or telescope within the beam 18 from the position of FIG. 1A to the position or state of FIG. 10. This may be said to increase the width of a top structure of the overall rigid frame structure, which may include beams 20 and 21.

Although the invention has been described by reference to particular illustrative embodiments thereof, many changes and modifications of the invention may become apparent to those skilled in the art without departing from the spirit and scope of the invention. It is therefore intended to include within this patent all such changes and modifications as may reasonably and properly be included within the scope of the present invention's contribution to the art.

I claim:

1. An apparatus comprising a rigid frame structure;

a first device for holding a first end of a first weightlifting bar;

wherein the first device includes a first flexible device and a first retainer device;

wherein the first flexible device has a first end and an opposite second end;

wherein the first retainer device is attached to the first flexible device at a location which is at the second end of the first flexible device or which is between the first end of the first flexible device and the second end of the first flexible device;

wherein the first flexible device can be removably attached to the rigid frame structure at the first end of the first flexible device or at any one of a plurality of locations between the first end of the first flexible device and the second end of the first flexible device;

a second device for holding a second end of the first weightlifting bar, opposite the first end of the first weightlifting bar;

wherein the second device includes a second flexible device and a second retainer device;

wherein the second flexible device has a first end and an opposite second end;

wherein the second retainer device is attached to the second flexible device at a location which is at the second end of the second flexible device or which is between the first end of the second flexible device and the second end of the second flexible device; and wherein the second flexible device can be removably attached to the rigid frame structure at the first end of the second flexible device or at any one of a plurality of locations between the first end of the second flexible device and the second end of the second flexible device; and the apparatus further comprising a third device for holding a first end of a second weightlifting bar;

wherein the third device includes a third flexible device and a third retainer device;

wherein the third flexible device has a first end and an opposite second end;

wherein the third retainer device is attached to the third flexible device at a location which is at the second end of the third flexible device or which is between the first end of the third flexible device and the second end of the third flexible device;

wherein the third flexible device can be removably attached to the rigid frame structure at the first end of the third flexible device or at any one of a plurality of locations between the first end of the third flexible device and the second end of the third flexible device;

a fourth device for holding a second end of the second weightlifting bar, opposite the first end of the second weightlifting bar;

wherein the fourth device includes a fourth flexible device and a fourth retainer device;

wherein the fourth flexible device has a first end and an opposite second end;

wherein the fourth retainer device is attached to the fourth flexible device at a location which is at the second end of the fourth flexible device or which is between the first end of the fourth flexible device and the second end of the fourth flexible device; and wherein the fourth flexible device can be removably attached to the rigid frame structure at the first end of the fourth flexible device or at any one of a plurality of locations between the first end of the fourth flexible device and the second end of the fourth flexible device wherein the rigid frame structure has a top structure having a length which is adjustable;

wherein the top structure includes a first inner rigid beam which telescopes inside of a first outer rigid beam, and a second inner rigid beam which telescopes inside of a second outer rigid beam;

wherein the telescoping of the first inner rigid beam within the first outer rigid beam together with the telescoping of the second inner rigid beam within the second outer rigid beam adjusts the length of the top structure; and and further comprising a first means for preventing the first inner rigid beam from falling out of the first outer rigid beam, and a second means for preventing the second inner rigid beam from falling out of the second outer rigid beam;

wherein the first flexible device and the second flexible device are configured to be removably attached to the first inner rigid beam of the rigid frame structure; and wherein the third flexible device and the fourth flexible device are configured to be removably attached to the second inner rigid beam of the rigid frame structure.

2. An apparatus comprising a rigid frame structure;

a first device for holding a first end of a first weightlifting bar;

wherein the first device includes a first flexible device and a first retainer device;

wherein the first flexible device has a first end and an opposite second end;

wherein the first retainer device is attached to the first flexible device at a location which is at the second end of the first flexible device or which is between the first end of the first flexible device and the second end of the first flexible device;

wherein the first flexible device can be removably attached to the rigid frame structure at the first end of the first flexible device or at any one of a plurality of locations between the first end of the first flexible device and the second end of the first flexible device;

a second device for holding a second end of the first weightlifting bar, opposite the first end of the first weightlifting bar;

wherein the second device includes a second flexible device and a second retainer device;

wherein the second flexible device has a first end and an opposite second end;

wherein the second retainer device is attached to the second flexible device at a location which is at the second end of the second flexible device or which is between the first end of the second flexible device and the second end of the second flexible device; and wherein the second flexible device can be removably attached to the rigid frame structure at the first end of the second flexible device or at any one of a plurality of locations between the first end of the second flexible device and the second end of the second flexible device; and further comprising a first elastic cord device having a first end removably attached to the rigid frame structure and a second end, opposite the first end of the first elastic cord device, removably attached to the first flexible device at a location between the first end of the first flexible device and the second end of the first flexible device; and a second elastic cord device having a first end removably attached to the rigid frame structure and a second end, opposite the first end of the second elastic cord device, removably attached to the second flexible device at a location between the first end of the second flexible device and the second end of the second flexible device.

3. The apparatus of claim 2 wherein the first weightlifting bar is a weightlifting dumbbell.

4. The apparatus of claim 2 wherein the rigid frame structure includes a structural member;

and wherein the rigid frame structure includes a means for adjusting the distance of the first device, and the second device from the structural member after the first device, and the second device have been removably attached to the rigid frame structure.

5. The apparatus of claim 2 wherein the first flexible device includes a chain having a plurality of chain links; and the second flexible device includes a chain having a plurality of chain links.

6. The apparatus of claim 2 wherein the rigid frame structure has an overall height which is adjustable.

7. The apparatus of claim 2 wherein the rigid frame structure has a top structure having a length which is adjustable.

8. An apparatus comprising a rigid frame structure;

a first device for holding a first end of a first weightlifting bar;

wherein the first device includes a first flexible device and a first retainer device;

wherein the first flexible device has a first end and an opposite second end;

wherein the first retainer device is attached to the first flexible device at a location which is at the second end of the first flexible device or which is between the first end of the first flexible device and the second end of the first flexible device;

wherein the first flexible device can be removably attached to the rigid frame structure at the first end of the first flexible device or at any one of a plurality of locations between the first end of the first flexible device and the second end of the first flexible device;

a second device for holding a second end of the first weightlifting bar, opposite the first end of the first weightlifting bar;

wherein the second device includes a second flexible device and a second retainer device;

wherein the second flexible device has a first end and an opposite second end;

wherein the second retainer device is attached to the second flexible device at a location which is at the second end of the second flexible device or which is between the first end of the second flexible device and the second end of the second flexible device; and wherein the second flexible device can be removably attached to the rigid frame structure at the first end of the second flexible device or at any one of a plurality of locations between the first end of the second flexible device and the second end of the second flexible device;

wherein the rigid frame structure has a top structure having a length which is adjustable;

wherein the top structure includes a first inner rigid beam which telescopes inside of a first outer rigid beam, and a second inner rigid beam which telescopes inside of a second outer rigid beam;

wherein the telescoping of the first inner rigid beam within the first outer rigid beam together with the telescoping of the second inner rigid beam within the second outer rigid beam adjusts the length of the top structure; and and further comprising a first means for preventing the first inner rigid beam from falling out of the first outer rigid beam, and a second means for preventing the second inner rigid beam from falling out of the second outer rigid beam.

9. An apparatus comprising a rigid frame structure;

a first device for holding a first end of a first weightlifting bar;

wherein the first device includes a first flexible device and a first retainer device;

wherein the first flexible device has a first end and an opposite second end;

wherein the first retainer device is attached to the first flexible device at a location which is at the second end of the first flexible device or which is between the first end of the first flexible device and the second end of the first flexible device;

wherein the first flexible device can be removably attached to the rigid frame structure at the first end of the first flexible device or at any one of a plurality of locations between the first end of the first flexible device and the second end of the first flexible device;

a second device for holding a second end of the first weightlifting bar, opposite the first end of the first weightlifting bar;

wherein the second device includes a second flexible device and a second retainer device;

wherein the second flexible device has a first end and an opposite second end;

wherein the second retainer device is attached to the second flexible device at a location which is at the second end of the second flexible device or which is between the first end of the second flexible device and the second end of the second flexible device; and wherein the second flexible device can be removably attached to the rigid frame structure at the first end of the second flexible device or at any one of a plurality of locations between the first end of the second flexible device and the second end of the second flexible device;

a first elastic cord device having a first end removably attached to the rigid frame structure and a second end, opposite the first end of the first elastic cord device, removably attached to the first flexible device at a location between the first end of the first flexible device and the second end of the first flexible device;

a second elastic cord device having a first end removably attached to the rigid frame structure and a second end, opposite the first end of the second elastic cord device, removably attached to the second flexible device at a location between the first end of the second flexible device and the second end of the second flexible device;

a third elastic cord device having a first end removably attached to the rigid frame structure and a second end, opposite the first end of the third elastic cord device, removably attached to a third flexible device at a location between a first end of the third flexible device and a second end of the third flexible device; and a fourth elastic cord device having a first end removably attached to the rigid frame structure and a second end, opposite the first end of the fourth elastic cord device, removably attached to a fourth flexible device at a location between a first end of the fourth flexible device and a second end of the fourth flexible device.

10. The apparatus of claim 9 wherein the first flexible device includes a chain having a plurality of chain links; and the second flexible device includes a chain having a plurality of chain links.

11. A method comprising attaching a first retainer device to a first flexible device at a location which is at a second end of the first flexible device or which is between a first end of the first flexible device and the second end of the first flexible device;

removably attaching the first flexible device to a rigid frame structure at the first end of the first flexible device or at any one of a plurality of locations between the first end of the first flexible device and the second end of the first flexible device;

inserting a first end of a first weightlifting bar into the first retainer device;

attaching a second retainer device to a second flexible device at a location which is at a second end of the second flexible device or which is between a first end of the second flexible device and the second end of the second flexible device;

removably attaching the second flexible device to the rigid frame structure at the first end of the second flexible device or at any one of a plurality of locations between the first end of the second flexible device and the second end of the second flexible device;

inserting a second end of the first weightlifting bar, opposite the first end of the first weightlifting bar, into the second retainer device;

attaching a third retainer device to a third flexible device at a location which is at a second end of the third flexible device or which is between a first end of the third flexible device and the second end of the third flexible device;

removably attaching the third flexible device to a rigid frame structure at the first end of the third flexible device or at any one of a plurality of locations between the first end of the third flexible device and the second end of the third flexible device;

inserting a first end of a second weightlifting bar into the third retainer device;

attaching a fourth retainer device to a fourth flexible device at a location which is at a second end of the fourth flexible device or which is between a first end of the fourth flexible device and the second end of the fourth flexible device;

removably attaching the fourth flexible device to the rigid frame structure at the first end of the fourth flexible device or at any one of a plurality of locations between the first end of the fourth flexible device and the second end of the fourth flexible device;

inserting a second end of the second weightlifting bar, opposite the first end of the second weightlifting bar, into the fourth retainer device; and wherein the rigid frame structure has a top structure having a length which is adjustable;

wherein the top structure includes a first inner rigid beam which telescopes inside of a first outer rigid beam, and a second inner rigid beam which telescopes inside of a second outer rigid beam;

wherein the telescoping of the first inner rigid beam within the first outer rigid beam together with the telescoping of the second inner rigid beam within the second outer rigid beam adjusts the length of the top structure; and wherein there is a first means for preventing the first inner rigid beam from falling out of the first outer rigid beam, and a second means for preventing the second inner rigid beam from falling out of the second outer rigid beam;

and wherein the first flexible device and the second flexible device are removably attached to the rigid frame structure by removably attaching the first flexible device and the second flexible device to the first inner rigid beam of the rigid frame structure;

and wherein the third flexible device and the fourth flexible device are removably attached to the rigid frame structure by removably attaching the third flexible device and the fourth flexible device to the second inner rigid beam of the rigid frame structure.

12. A method comprising attaching a first retainer device to a first flexible device at a location which is at a second end of the first flexible device or which is between a first end of the first flexible device and the second end of the first flexible device;

removably attaching the first flexible device to a rigid frame structure at the first end of the first flexible device or at any one of a plurality of locations between the first end of the first flexible device and the second end of the first flexible device;

inserting a first end of a first weightlifting bar into the first retainer device;

attaching a second retainer device to a second flexible device at a location which is at a second end of the second flexible device or which is between a first end of the second flexible device and the second end of the second flexible device;

removably attaching the second flexible device to the rigid frame structure at the first end of the second flexible device or at any one of a plurality of locations between the first end of the second flexible device and the second end of the second flexible device;

inserting a second end of the first weightlifting bar, opposite the first end of the first weightlifting bar, into the second retainer device; and further comprising removably attaching a first end of a first elastic cord device to the rigid frame structure and removably attaching a second end, opposite the first end of the first elastic cord device, to the first flexible device at a location between the first end of the first flexible device and the second end of the first flexible device; and removably attaching a first end of a second elastic cord device to the rigid frame structure and removably attaching a second end, opposite the first end of the second elastic cord device, to the second flexible device at a location between the first end of the second flexible device and the second end of the second flexible device.

13. The method of claim 12 wherein the first weightlifting bar is a weightlifting dumbbell.

14. The method of claim 12 further comprising adjusting the distance of the first device, and the second device from a structural member of the rigid frame structure after the first device, and the second device have been removably attached to the rigid frame structure.

15. The method of claim 12 wherein the first flexible device includes a chain having a plurality of chain links; and the second flexible device includes a chain having a plurality of chain links.

16. The method of claim 12 wherein the rigid frame structure has an overall height which is adjustable.

17. The method of claim 12 wherein the rigid frame structure has a top structure having a length which is adjustable.

18. A method comprising attaching a first retainer device to a first flexible device at a location which is at a second end of the first flexible device or which is between a first end of the first flexible device and the second end of the first flexible device;

removably attaching the first flexible device to a rigid frame structure at the first end of the first flexible device or at any one of a plurality of locations between the first end of the first flexible device and the second end of the first flexible device;

inserting a first end of a first weightlifting bar into the first retainer device;

attaching a second retainer device to a second flexible device at a location which is at a second end of the second flexible device or which is between a first end of the second flexible device and the second end of the second flexible device;

removably attaching the second flexible device to the rigid frame structure at the first end of the second flexible device or at any one of a plurality of locations between the first end of the second flexible device and the second end of the second flexible device;

inserting a second end of the first weightlifting bar, opposite the first end of the first weightlifting bar, into the second retainer device;

removably attaching a first end of a first elastic cord device to the rigid frame structure and removably attaching a second end, opposite the first end of the first elastic cord device, to the first flexible device at a location between the first end of the first flexible device and the second end of the first flexible device;

removably attaching a first end of a second elastic cord device to the rigid frame structure and removably attaching a second end, opposite the first end of the first elastic cord device, to the second flexible device at a location between the first end of the second flexible device and the second end of the second flexible device;

removably attaching a first end of a third elastic cord device to the rigid frame structure and removably attaching a second end, opposite the first end of the third elastic cord device, to a third flexible device at a location between a first end of the third flexible device and a second end of the third flexible device; and removably attaching a first end of a fourth elastic cord device to the rigid frame structure and removably attaching a second end, opposite the first end of the fourth elastic cord device, to a fourth flexible device at a location between a first end of the fourth flexible device and a second end of the fourth flexible device.

19. An apparatus comprising a rigid frame structure;

a first device for holding a first end of a first weightlifting bar;

wherein the first device includes a first flexible device and a first retainer device;

wherein the first flexible device has a first end and an opposite second end;

wherein the first retainer device is attached to the first flexible device at a location which is at the second end of the first flexible device or which is between the first end of the first flexible device and the second end of the first flexible device;

wherein the first flexible device can be removably attached to the rigid frame structure at the first end of the first flexible device or at any one of a plurality of locations between the first end of the first flexible device and the second end of the first flexible device;

a second device for holding a second end of the first weightlifting bar, opposite the first end of the first weightlifting bar;

wherein the second device includes a second flexible device and a second retainer device;

wherein the second flexible device has a first end and an opposite second end;

wherein the second retainer device is attached to the second flexible device at a location which is at the second end of the second flexible device or which is between the first end of the second flexible device and the second end of the second flexible device; and wherein the second flexible device can be removably attached to the rigid frame structure at the first end of the second flexible device or at any one of a plurality of locations between the first end of the second flexible device and the second end of the second flexible device;

and the apparatus further comprising a third device for holding a first end of a second weightlifting bar;

wherein the third device includes a third flexible device and a third retainer device;

wherein the third flexible device has a first end and an opposite second end;

wherein the third retainer device is attached to the third flexible device at a location which is at the second end of the third flexible device or which is between the first end of the third flexible device and the second end of the third flexible device;

wherein the third flexible device can be removably attached to the rigid frame structure at the first end of the third flexible device or at any one of a plurality of locations between the first end of the third flexible device and the second end of the third flexible device;

a fourth device for holding a second end of the second weightlifting bar, opposite the first end of the second weightlifting bar;

wherein the fourth device includes a fourth flexible device and a fourth retainer device;

wherein the fourth flexible device has a first end and an opposite second end;

wherein the fourth retainer device is attached to the fourth flexible device at a location which is at the second end of the fourth flexible device or which is between the first end of the fourth flexible device and the second end of the fourth flexible device; and wherein the fourth flexible device can be removably attached to the rigid frame structure at the first end of the fourth flexible device or at any one of a plurality of locations between the first end of the fourth flexible device and the second end of the fourth flexible device;

wherein the rigid frame structure has a top structure having a length which is adjustable; and wherein the top structure has a width which is adjustable, wherein the width is substantially perpendicular to the length.

20. A method comprising attaching a first retainer device to a first flexible device at a location which is at a second end of the first flexible device or which is between a first end of the first flexible device and the second end of the first flexible device;

removably attaching the first flexible device to a rigid frame structure at the first end of the first flexible device or at any one of a plurality of locations between the first end of the first flexible device and the second end of the first flexible device;

inserting a first end of a first weightlifting bar into the first retainer device;

attaching a second retainer device to a second flexible device at a location which is at a second end of the second flexible device or which is between a first end of the second flexible device and the second end of the second flexible device;

removably attaching the second flexible device to the rigid frame structure at the first end of the second flexible device or at any one of a plurality of locations between the first end of the second flexible device and the second end of the second flexible device; and inserting a second end of the first weightlifting bar, opposite the first end of the first weightlifting bar, into the second retainer device;

and further comprising removably attaching a first end of a first elastic cord device to the rigid frame structure and removably attaching a second end, opposite the first end of the first elastic cord device, to the first flexible device at a location between the first end of the first flexible device and the second end of the first flexible device; and removably attaching a first end of a second elastic cord device to the rigid frame structure and removably attaching a second end, opposite the first end of the first second elastic cord device, to the second flexible device at a location between the first end of the second flexible device and the second end of the second flexible device;

wherein the rigid frame structure has a top structure having a length which is adjustable; and wherein the top structure has a width which is adjustable, wherein the width is substantially perpendicular to the length.

* * * * *